US006477930B1

(12) United States Patent
Sandford

(10) Patent No.: US 6,477,930 B1
(45) Date of Patent: Nov. 12, 2002

(54) JOGGER MEMBER, SYSTEM AND METHOD FOR MOUNTING JOGGER MEMBERS AND FEMALE AND MALE BLANKING DIES PROVIDED THEREWITH

(76) Inventor: Peter E. Sandford, 176 Stronach Crescent, London, Ontario (CA), N5V 3A1

( * ) Notice: Subject to any disclaimer, the term of this patent is extended or adjusted under 35 U.S.C. 154(b) by 0 days.

(21) Appl. No.: 09/372,622

(22) Filed: Aug. 12, 1999

(30) Foreign Application Priority Data

Jan. 19, 1999 (CA) ..... 2259785

(51) Int. Cl.[7] ..... B26D 1/11

(52) U.S. Cl. ..... 83/162; 83/440.1; 83/690

(58) Field of Search ..... 83/111, 162, 440, 83/440.1, 690; 493/82, 83, 342, 373; 29/465, 466, 469; 76/107; 225/97

(56) References Cited

U.S. PATENT DOCUMENTS

| | | | |
|---|---|---|---|
| 1,501,072 A | 7/1924 | Stanbon | |
| 2,341,284 A | 2/1944 | Payne | 33/181 |
| 2,381,062 A | 8/1945 | Kirsch | 164/90 |

(List continued on next page.)

*Primary Examiner*—Joseph J. Hail, III
(74) *Attorney, Agent, or Firm*—Birch, Stewart, Kolasch & Birch, LLP

(57) ABSTRACT

A female blanking die for a die cutting machine for die cutting and/or blanking a carton blank, as well as a male blanking die/female blanking die combination, and methods of producing them, and elements constituting essential integers thereof, are all provided herein. The male blanking die/female blanking die combination includes a specifically-configured male stripping die. Such male stripping die includes a template having a particularly-specified perimeter, the template including a plurality of foam plastic pads which are removably secured to the undersurface of the template, the template being accurately secured at a predetermined position to the underface of a movable upper plate of the blanking station of the die cutting machine. The male blanking die/female blanking die combination also includes a specifically-configured female blanking die. Such female stripping die includes a rectangular framework and a plurality of grid support members, each grid support member having a slot across its upper face, the grid support members being selectively disposed along the internal perimeter of the rectangular framework. A grid is provided comprising a plurality of intersecting rails, the pattern of the intersecting rails having a predefined shape. The grid is disposed within the slots atop the grid support members. A plurality of jogger members are provided which are selectively disposed along the internal perimeter of the rectangular framework, each jogging member having a particularly-recited structure. The plurality of jogger members are oriented along the internal perimeter of the rectangular framework in a particularly-recited way. The female blanking die is accurately secured at a predetermined position atop a lower fixed plate of the blanking station of the die cutting machine. The male blanking die and the female blanking die are accurately aligned to cooperate to press and separate the carton blanks from a web holding them together, and to force the separated cartons through aligned openings in the female blanking die.

8 Claims, 18 Drawing Sheets

U.S. PATENT DOCUMENTS

| | | | | |
|---|---|---|---|---|
| 2,504,642 | A | 4/1950 | Burgess | 29/148 |
| 2,572,537 | A | 10/1951 | Taylor | 93/36 |
| 2,845,011 | A | 7/1958 | Schilling | 93/36 |
| 3,126,766 | A | 3/1964 | Whistler, Sr. et al. | 83/13 |
| 3,148,572 | A | 9/1964 | Lindholm | 83/145 |
| 3,150,550 | A | 9/1964 | Berlin et al. | 83/13 |
| 3,249,272 | A | 5/1966 | Scarpa | 225/1 |
| 3,335,704 | A | 8/1967 | Freebourn | 118/504 |
| 3,386,781 | A | 6/1968 | Blazek et al. | 308/4 |
| 3,504,576 | A | 4/1970 | Silberman et al. | 76/107 |
| 3,513,756 | A | 5/1970 | Schutz | 93/36 |
| 3,554,060 | A | 1/1971 | Gargrave et al. | 76/107 |
| 3,786,731 | A | 1/1974 | Bobst et al. | 93/36 |
| 4,164,076 | A | 8/1979 | Carrigan | 33/181 |
| 4,174,576 | A | 11/1979 | Shepard | 33/181 |
| 4,175,686 | A | 11/1979 | Lang | 225/97 |
| 4,359,915 | A | 11/1982 | Mascimento | 76/107 |
| 4,371,369 | A | 2/1983 | Wright, III | 493/373 |
| 4,397,094 | A | 8/1983 | Nakamura | 33/181 |
| 4,397,095 | A | 8/1983 | Graboyes | 33/181 |
| 4,452,597 | A | 6/1984 | Huff | 493/83 |
| 4,489,499 | A | 12/1984 | Frissora | 33/181 |
| 4,494,455 | A | 1/1985 | Schoch | 101/3 |
| 4,555,840 | A | 12/1985 | Nakamura | 29/465 |
| 4,740,193 | A | 4/1988 | Frost et al. | 493/82 |
| 4,913,016 | A | 4/1990 | Frei | 83/103 |
| 4,921,154 | A | 5/1990 | Abe et al. | 225/97 |
| 5,147,269 | A | 9/1992 | Jondelius | 493/57 |
| 5,179,882 | A | 1/1993 | Takeuchi | 83/125 |
| 5,322,202 | A | 6/1994 | Pelletier | 225/97 |
| 5,337,639 | A | 8/1994 | Morrison | 83/111 |
| 5,402,698 | A | 4/1995 | Morrison | 83/39 |
| 5,810,233 | A | 9/1998 | Varidel | 225/97 |

JOGGER MEMBER, SYSTEM AND METHOD FOR MOUNTING JOGGER MEMBERS AND FEMALE AND MALE BLANKING DIES PROVIDED THEREWITH

BACKGROUND OF THE INVENTION (i) Field of the Invention

The present invention relates generally to an improvement in apparatus for the automatic die cutting of blanks primarily for making formable paperboard containers. In particular, it relates to improvements in the blanking operation to assist in the removal of the carton blanks, after the stripping operation, in an efficient manner.

(ii) Description of the Prior Art

With the advent of many different sizes, shapes and configurations of cardboard or similar type containers, it is well-known in the art to die-cut, strip and blank cardboard box blanks using an automatic sequential press or die cutting machine. By automating the process and by using computer-aided technology, it is now possible to confiture die-cut blanks in a limitless number of dimensions and specifications and, as well, to lay-out any number of blanks on a single sheet of cardboard while automatically cutting, stripping and blanking the sheets with little or no human operator intervention. One typical system and press known in the art is discussed in U.S. Pat. No. 5,337,639, issued Aug. 16, 1994 and assigned to Die-X Tooling Systems.

As described in that U.S. Pat. No. 5,337,639, computer technology, combined with attendant laser technology, has enabled cardboard box manufacturers to utilize highly accurate cutting and creasing dies for producing a planar sheet of die-cut blanks, and also to produce male and female blanking dies used automatically to separate the die-cut or stamped forms from the intervening web or waste portion of the sheet. Automatic blanking, in particular, results in a tremendous cost savings compared to the identical operation when performed by labourers using manual blanking means.

The current technology and the known prior art includes automatic systems or presses that feed large sheets of cardboard for cutting and scoring of blanks and also, for automatically stripping the excess cardboard from the stamped cardboard sheet, leaving a flexible thin webbing supporting the various rows of stamped carton forms. The known prior art also contemplated the use of a male and female combination blanking die for automatically separating the planar forms from the flexible web. The male die, effective through the use of a blanking member, pushed each of the cardboard cartons which were blanked through the web and through the apertures in the supporting female die. The thin web typically remained on the face of the female die while the separated blanks were pushed through the blanking holes into a stack below the female blanking die.

For speed and efficiency, the prior art also contemplated the use of a travelling feed bar and grippers to "pull" a cardboard sheet through the various stations of the machine on a continuous chain drive or other mechanism, thereby automatically feeding the sheet from station to station. Similarly, in most applications, the remaining flexible web on the face of the female die after blanking was also pulled away through the use of the travelling bar and grippers into a waste container or other receptacle at the end of the machine.

The general configuration of automatic die cutting machines for the production of such die-cut blanks is well-known. A sheet of cardboard blank material was automatically interposed or urged by mechanical means beneath the surface of a cutting die as part of the first stage of the operation. The cutting die comprised a planar die having specially configured cutting edges which were created through the use of computer and laser technology to reflect a particular series of die-cut blank lay-outs for cutting. Once a sheet was interposed under the cutting die on a cutting platen, the cutting die was pressed onto the sheet from below thereby causing the sheet to be "cut" or "scored" by the cutting die thereabove.

While not essential for a thorough understanding of the present invention, a typical system and press known in the art for automatic die cutting and blanking, which is taught in that U.S. Pat. No. 5,337,639, will now be briefly described.

The press generally comprised means for feeding a series of blank, planar sheets into the press or system, e.g., by the use of a travelling bar and appended pulling grippers and then to a scoring and/or cutting station. Thereafter, at the scoring or stamping station, a plurality of rows and columns of die-cut forms were stamped or scored on to the cardboard sheet, although the cardboard sheet remained in one piece and was next pulled automatically to a stripping station where much of the small pieces of excess cardboard around the die-cut forms was automatically removed. What remained was a series of stamped and creased die-cut forms which were held together by a thin web therebetween. The thin web and attached die-cut blanks were then automatically pulled into a blanking station where the die-cut blanks were completely separated from the web and were dropped onto a pallet for transfer.

The blanking station specifically included the use of a male blanking die/female blanking die combination which, when engaged, pressed and separated the box blanks from the web and onto the pallet. The remaining thin web lay on the face of the female die component and was ready for disposal in a disposal area at the end of the press. As a result of the blanking operation, a planar cardboard blank was produced and was in a condition for assembly, by automatic folding or otherwise, and for the insertion of merchandise, food stuffs or other products to be contained therein.

That male blanking die/female blanking die combination included a female blanking die portion and a complementary male blanking die for blanking or separating die-cut cardboard carton blanks or other forms into a detached web and a substantially planar and unassembled die-cut cardboard blank. The die-cut cardboard sheet was automatically pulled through the press, and over the female die portion, through the use of travelling bar having appended gripper fingers which were adapted to grip the leading edge of the die-cut sheet.

After blanking, the web remained on the face of the female die portion and included a series of intermediate web portions which, together, formed an extremely flexible and flimsy cardboard "skeleton" which must be removed from the female blanking die face. In actual operation, the travelling bar and appended grippers pulled the flexible web over the female blanking die face, including the leading edges of the female blanking die.

In the operation of the blanking dies, the male blanking die was pressed downward through the corresponding through holes in the female blanking die, thereby separating and pushing the blanked cardboard carton through the through holes, resulting in die-cut blanks and leaving a cardboard web on the surface of the female blanking die. At this point, it was then necessary automatically to remove the remaining web portion from the face of the female blanking die by use of the travelling bar and grippers.

After the initial cutting process, the entire cut or scored sheet was automatically pulled or urged into a second (or "stripping") station for the operation for the stripping away of most of the excess material from around the cut box blanks. The stripping operation comprised the use of a female stripping tool onto which the cut sheet was automatically interposed. The female stripping tool had a series of configured openings which corresponded to the cut portions of the cut sheet and was adapted to receive the male stripping tool from above. The male stripping tool cooperated with the female stripping tool, and effectively broke away and separated the majority of excess material from the box blanks by being urged downwardly onto the sheet arranged over the female stripping tool. It was, of course, critical that the male and female stripping tools be aligned precisely and that the cut sheet be arranged in alignment therebetween to insure that stripping was effectively accomplished without tearing of the box flank, jamming of the machine or damage thereto. Further, precise alignment was required on account of the narrow tolerances necessary to assemble the box or container which was formed from the cut sheet.

On machines so configured, the stripped sheet was next urged in between yet another series of male and female blanking tools which were arranged one above the other, which were again required to be in precise alignment. The female blanking tool was adapted to receive thereabove the die-cut blank which was stripped at the previous station and which had a series of openings directly corresponding to the shapes of the cut boxes to be blanked. In turn, the corresponding male blanking tool of similar contour to that of the female tool was adapted to push the cut box blanks free from any remaining extraneous material and through the female blanking tool into a stack therebelow. Accordingly it was once again required that the male and female blanking tools be carefully aligned and that the sheet to be blanked was precisely arranged therebetween to avoid problems similar to those described in the stripping portion of the operation. After blanking was completed, the remaining extraneous material is then urged off the face of the female blanking tool into a refuse area and the process continues from the beginning.

It is well known and recognized in the prior art that set-up of the cardboard blank cutting machine is critical to efficient and proper automatic cutting, stripping and blanking of multiple box blanks. The alignment method currently practised in the art was a manual one relying upon the senses and vision of the operator in manual adjustment of the stripping and blanking tools through use of the applicable alignment means of a particular machine press. Accordingly, it was not unusual for machine set-up to take anywhere from four to six hours, especially for complex box layouts comprising various series of boxes and orientations. On account of the precision required and the high tolerances of the components, the method of manually setting up the machine may require that the machine be "down" for extended periods of time between production runs. This, of course, resulted in diminished capacity and productivity and affected the overall cost of production and price of the box blanks.

Many patents have been issued which were concerning with accurate aligning of parts of a die cutting machine, even though they were not specifically directed to assisting in the removal of cardboard carton blanks, after a stripping operation.

One such patent was U.S. Pat. No. 1,501,072, patented Jul. 15, 1929, to H. R. Stanborn, which provided a machine for preparing shoe parts having, in combination, perforating means, a pair of jig hole forming members adjacent to and in predetermined relation to the perforating means, and a work presenter having a pair of jig pins arranged to be received by jig holes formed in the stock by the jig hole forming members to position the stock for the performance of a subsequent operation.

Another patent was U.S. Pat. No. 2,504,642, patented Apr. 18, 1950, by W. D. Burgess, which provided a method of positioning die and punch holders in correct positions relatively to each other on die and punch shoes on which they may be adjusted and fastened. The method included positioning the die holders by means of a template and positioning the punch holders by means of setup plugs which fit in the die holders and which had a bore equal to the diameter of the punch body. A punch with a setup plug therein was first attached to a punch holder, after which the setup plug was moved into position on a die holder correctly to position the punch holder relatively to the die holder.

Another patent was U.S. Pat. No. 2,341,284, patented Feb. 8, 1944, by R. S. Payen, which provided an alignment gauge for axially aligning a pair of cooperative tools, which included a member having a tool-engaging part movable axially in the member, a second member engaged with the first member, and having a tool-engaging part movable axially in the second member. One of the members was movable relatively to the other transversely of the axis of the tool-engaging parts. Registering means on the respective members were adapted to register with each other in the axially-aligned relation of the tool-engaging parts.

Another patent was U.S. Pat. No. 2,381,062, patented Aug. 7, 1945, by F. K. Kirsch, which provided die sets for use with mounting plates of various sizes having punch and die units mounted therein. The die set had a plurality of groups of accurately formed aligned pairs of round holes which were arranged in the punch holder and in the die shoe of the die set. The holes of each group were in accurate predetermined spaced relation to each other, and to other holes of the same group, which corresponded to the spacing of locating holes in the mounting plates. Accurately formed cylindrical parts were formed to fit into a group of holes of a die set and of a mounting plate to align the holes and the means on the cylindrical parts to secure the cylindrical parts in the holes.

Yet another patent was U.S. Pat. No. 2,504,642, patented Apr. 18, 1950, to W. D. Burgess, which provided a method for positioning die and punch holders in correct positions relative to each other on die and punch shoes on which they may be adjusted and fastened. The method included positioning the die holders by means of a template and positioning the punch holders by means of setup plugs which fit in the die holders and had a bore which was equal to the diameter of the punch body. A punch with a setup plug therein was first attached to a punch holder, after which the setup plug was moved into position on a die holder correctly to position the punch holder relatively to the die holder.

Still another patent was U.S. Pat. No. 3,126,776, patented Mar. 31, 1964, by L. V. Shisler et al., which provided a method of aligning the punch and die retainers of a die set. The method included fixedly mounting a first retainer upon an associated shoe in the proper position. Then, a spotting fixture was mounted on the first retainer so as to prevent relative rotation therebetween. A supporting shoe was brought into contact with an upper portion of the spotting fixture to provide an indication on the under surface of the supporting shoe of the proper position of mounting holes. The supporting shoe was then removed from contact with the spotting fixture and mounting holes were formed in the supporting shoe. A second retainer was loosely mounted on the supporting shoe by inserting attaching means in the mounting holes. Then the first and second retainers were accurately aligned, and finally, the second retainer was secured in final fixed position on the supporting shoe.

Yet a further patent was U.S. Pat. No. 3,150,550, patented Sep. 29, 1964 by M. Berlin et al., which provided a method of resetting a female rule die member and a rigid male punch member which previously were matched, aligned and mounted as a unit in a device having two relatively reciprocatable parts. The method included the steps of mounting the members on the reciprocatable parts of such a device so that at least one member was shiftable relative to its associated part in two orthogonal directions which were perpendicular to the direction of relative movement of the parts. The compression means were then manipulated to constrict the die blade. One member was then relatively shifted in the two orthogonal directions so as to align the two members. Subsequently one member was fixedly secured to its associated part.

Still a further patent was U.S. Pat. No. 3,335,704, patented Aug. 15, 1962, by J. F. Freebourn, which provided a coating apparatus which included a masking member, and means to support such member. Movable means supported a substrate, and means were provided to move the substrate support whereby to associate substrate and masking member for the coating operation. The coating apparatus included aligning means comprising pairs of tapered pin elements and aperture means which were adapted to receive the elements when moved to associate the substrate and masking member. The pin elements were mounted on one of either the masking member or the substrate supports and the aperture means were mounted on the other of the supports. The aperture means included a ball and socket type joint in order to inhibit binding, of a pin element with its cooperating aperture means, upon the movement to associate the substrate and masking member.

Another patent was U.S. Pat. No. 3,386,781, patented Jun. 4, 1968, by W. J. Blazek et al., which provided a die set comprising a pair of members which were movable toward and from one another. Means were provided for maintaining alignment between the members during movement thereof, the means including a guide pin which was carried for limited lateral adjustment on one of the members and which telescoped with a tubular guide bushing which was carried for limited lateral adjustment on the other of the members. Fastening means were carried by each of the members for detachably securing the guide pin and bushing respectively thereto. The fastening means provided for limited lateral adjustment of the positions of attachment of the pin and the bushing to the members.

Still another patent was U.S. Pat. No. 3,504,576, patented Apr. 7, 1970, by R. L. Silberman et al., which provided a precision die set comprising a punch holder and a die holder and a method of making a precision die set. The punch holder and die holder were guided for precise movement relative to one another by guide posts which were secured at one end to the die holder and which cooperated with bushings which were affixed to the punch holder. The guide posts and bushings were loosely received in non-precision made openings in the punch holder and die holder and were retained in place by epoxy adhesive. Epoxy adhesive was applied between the bushings and punch holder and between the guide posts and die holder. Before the epoxy adhesive was cured, the guide posts were disposed perpendicular to the die holder and parallel to one another, with the guide posts engaging with their associated bushings so as properly to position the bushings in the punch holder. Then, the epoxy adhesive was cured to retain the components in precise assembled relationship.

A further patent was U.S. Pat. No. 3,554,060, patented Jan. 12, 1971, by R. L. Gargrave et al., which provided a die element, a plurality of which formed a die assembly. The die element included a stock die plate, the plate having a pattern of holes including two rows of spaced holes which were arranged in opposite lines respectively located in opposite peripheral edge portions of the plate formed therein. A first portion of the holes was arranged in a series successively positioned, in sequence, first in one, then in the other of the rows, and were successively offset from row to row. The holes of the series each had a counterbore in one end thereof, the counterbores of the series opening from a common surface of the plate to define a truss-like pattern for application of bolts or screws to nest the heads thereof or nuts applied thereto in the plate and to have the bodies thereof projected selectively to fix the plate to a die shoe or to suspend a stripper or like plate therefrom. A second portion of the holes, which was different from the first portion was arranged in a series similarly to the first portion but in a reverse pattern. Each of the holes in the reverse pattern had a counterbore in the end thereof which opened from a surface of the plate opposite that surface from which the first counterbores opened.

Yet another patent was U.S. Pat. No. 4,164,076 patented Aug. 14, 1979, by R. J. Corrigan, which provided a mounting plate for securing the position of a machine tool. Such mounting plate included a plurality of slot groupings extending radially from a plate centre point, radial axes of each slot group being distributed equiangularly about the centerpoint. Each slot grouping included at least two spaced lines of short, spaced slots extending parallel with the respective radial axis. The slots and spaces were aligned in radial sequence along a respective line and laterally offset by the slot and space sequence of the other line. A space of one line was therefore laterally flanked by a slot in the other line.

Still a further patent was U.S. Pat. No. 4,359,915, patented Nov. 23, 1982, by A. V. Nascimento, which provided a method of making a precision die set which included the first step of mounting a first retainer block upon a die shoe in the proper position by alignment with a punch shoe and applying shear plastic to hold the retainer block in position. That step was repeated with a multiplicity of retainer blocks. The retainer blocks were secured to the die shoe by means of a metal top plate. The die shoe assembly was then removed from a pedestal. Appropriate dowel-receiving and screw-receiving holes were then appropriately drilled.

Yet a further patent was U.S. Pat. No. 4,397,094, patented Aug. 9, 1983, by I. Nukamura, which provided an apparatus for accurately locating and aligning dies. The apparatus included a die changing apparatus including a pair of upper and lower die fixtures having locating pins on the sides facing each other. A pair of base plates was provided for securing upper and lower dies having a plurality of openings which were sized and positioned for receiving the locating pins for locating one each of the base plate on the fixtures. Means were provided for removably securing one of the base plates on each fixture. At least two guide posts each had a stud portion which was sized and positioned for insertion into one of the openings, which were provided in one base plate of the pair of the base plates and a guide portion to be inserted into another of the openings which were provided on a remaining base plate of the pair of the base plates for permitting vertically reciprocal movement of the other base plate along the length of the guide post. The guide portion and the stud portion were coaxial and were of the same diameter in order to permit precise alignment of the dies on the base plates relative to the openings therein. Means were provided for removably fastening each guide post to the base plates so as temporarily to erect each guide post on the base plates prior to positioning the base plates on the die changing apparatus fixture via the pins and openings.

Yet a further such patent was U.S. Pat. No. 4,397,095, patented Aug. 9, 1983, by H. A. Graboyes, which provided means for securing the die over the counterplate in an opposed face-to-face manner and in a precise aligned relationship for transfer to a press where the scoring and cutting of sheet material can occur. The die and counterplate securing means included a bushing having a longitudinal bore and a guide pin which was adapted to fit snugly into the longitudinal bore of the bushing. An opening was formed in one of the die and counterplate, and the bushing fitted into that opening and was secured to one of the die and counterplate. The bushing included an end portion extending beyond the opposing face of one of the die and counterplate. The end portion of the bushing had a transverse bore therethrough intersecting its longitudinal bore. The guide pin was secured to the other of the die and counterplate, the guide pin protruding from the opposing face of the other of the die and counterplate and having a side wall with a groove therein. The guide pin fitted into the longitudinal bore of the bushing when the die and counterplate were in their aligned relationship with said guide pin groove registering with the transverse bore of the bushing. A removable lock pin means was fitable into the registering guide pin groove and transverse bore of the bushing for securing the guide pin within the bushing. The guide pin groove had a width exceeding the transverse dimension of the lock pin means to permit limited relative longitudinal movement of the guide pin within the bushing to allow aligned movement of the die relative to the counterplate.

Yet a further such patent was U.S. Pat. No. 4,555,840, patented Dec. 3, 1987, by I. Nakamura, which provided a method for accurately locating and aligning dies with respect to a pair of upper and lower die fixtures having locating pins. The method included the steps of first uprightly mounting guide posts in openings of one of a pair of base plates by inserting ends of the guide posts into the openings of the base plate. The openings of one base plate were positioned such that the locating pins of one of such die fixtures fit therein when that one of the base plates was mounted therein. Then a remaining one of the pins of the base plates was mounted for vertically reciprocal movement on the uprightly erected guide posts by slidably inserting the other ends of the guide posts into openings of the remaining base plate of the pair of base plates, thereby assembling a pair of the base plates in the form of a die set accurately aligning the openings of the respective base plates. The openings of the remaining base plate were positioned such that the locating pins of another of the die fixtures fit therein when the remaining base plate was mounted therein. The dies were then located in the pair of the base plates assembled in the form of the die set for accurately aligning each of the dies, the dies were secured to respective ones of the base plates in defined locations thereof. One base plate was mounted to the die fixture with the pins of the one die fixture being inserted in the holes of the one base plate. Finally, the remaining base plate was mounted to said another die fixture with the pins of another die fixture inserted in the holes of the remaining base plate.

Many other patents were concerned with the assisting in the removal of the waste around the cardboard or corrugated cardboard blanks after a stripping operation. One such patent is U.S. Pat. No. 2,572,537, patented Oct. 23, 1951, by E. L. Taylor. which provided a stripping machine for stripping waste material from stacks of scored cardboard blanks. That machine included a frame, a bed supported by the frame, a member operable perpendicular to the upper surface of the bed, and a die of substantially the same configuration as the score lines of the blanks which was supported on the upper surface of the bed. The edge of the die was formed to extend slightly outwardly from and along, the scored lines of the blanks. A stripping tool of the same configuration as the scored lines of the blanks was carried by the member and was adapted to pass slightly inwardly from, and along, the opposite side of the scored lines. A stack guide having three vertical walls was arranged in U-formation on the bed for positioning the scored lines of the stack along lines which were substantially equidistant from the edges of the die and the stripping tool. Means were provided for controlling the operation of the member.

Another patent was U.S. Pat. No. 3,148,572, patented Sep. 15, 1964, by A. W. Lindholm, which provided a die having a sharpened edge which was formed by a bevel which was contoured to cut a plurality of blanks of predetermined shape from a stack of sheets. The die had a re-entrant portion which located portions of the bevel in opposed relation on opposite sides of a stack of scrap and so acted to wedge the sheets in the stack of scrap between opposite bevels as the cutting progressed, and a slitting knife edge to sever the scrap adjacent re-entrant portion. A wedge-like piece had a tapered end which merged with the bevel adjacent the cutting edge. The wedge-like piece was secured to the surface of the die adjacent to the re-entrant portion and between the re-entrant portion and the slitting knife to eject the scrap from the re-entrant portion as the cutting progressed by the slitting knife and die to clear the re-entrant portion of the die.

Still another patent was U.S. Pat. No. 3,249,272, patented May 3, 1966, by R. Scarpe, which provided a stripper having means to separate waste from die-cut sheets which were intermittently and laterally fed to the stripper, by urging the waste and the remaining sheet portion into separate horizontal planes. The sheet was supported during separation by means of a frame, and a plurality of horizontally elongated runners. Means were provided for slidably positioning said runners on the frame adjacent either side of the waste to be removed.

Another patent was U.S. Pat. No. 3,786,731, patented Jan. 2, 1974, by J. Bobst et al., which provided a press for carrying sheet material wherein waste was stripped from the sheet material by stripping tools. A cradle was mounted for reciprocatable movement within the press relative to the sheet to be stripped. A carriage was mounted for pivotable movement on the cradle. A frame was mounted for slidable movement within the carriage whereby the frame can be withdrawn from the side of said carriage and press. Stripping tools were mounted on the frame. Another patent was U.S. Pat. No. 4,174,576, patented Nov. 20, 1979, by M. L. Shepard, which provided an assembly jig for corrugating machine finger-holder units which included a side plate and a base plate which were integrally joined in mutually perpendicular planes. A reference axis was disposed perpendicularly to the side plate. Holder mounting means were provided on the base plate to locate and secure a finger holder in substantially the same spacial position relative to the reference axis as the holder would occupy when mounted on a subject corrugating machine. First adjustable surface means was secured to the side plate at a radial distance from the reference axis approximately the same as a radius of a subject corrugating roll for locating one arcuate end of a stripper finger in substantially the same spacial position relative to the reference axis and holder mounting means as that one arcuate end would occupy one said subject corrugating machine. A plurality of second adjustable surface means was secured to the side plate in an arcuate distribution relative to the reference axis for locating intermediate arcuate surface points on the stripper finger in substantially the same spacial positions relative to the reference axis and holder means as the intermediate points would occupy on the subject corrugating machine. Finally clamping means were provided temporarily to secure the stripper finger to the side plate in simultaneous contact position with the adjustable surface means.

Still another patent was U.S. Pat. No. 4,175,686, patented Nov. 27 1979, by P. Lang, which provided a device for stripping blanks from a die-cut sheet of blanks, which included a set of punches which was mounted on a punch frame and a matrix which was supported on a support frame and which had openings corresponding to the outlines of both the punches and blanks. One of the frames was movable relative to the other so that the punches can extend into the openings of the matrix to force the blanks through the matrix openings to strip them from the sheet. Each of the punches of the set of punches was provided as a plurality of punch members. Means extended between adjacent punch members to close the outline of each punch. The punch members were adjustably mounted on a first set of bars which were supported on the punch frame and which were slidable therealong to vary the size of the outline of each punch. The matrix included a first set of parallel extending members, a second set of parallel extending members and a plurality of removable fastening means for interconnection. The support frame was rectangular with one set of parallel sides being at one level and second set of parallel sides being at a different level. The first set of parallel extending embers was adjustably-mounted on the first set of parallel sides and was shiftable therealong to adjust the distance therebetween. The second set of parallel extending members was adjustably-mounted on the second set of parallel sides to over lie and extend across the first set and was shiftable therealong to adjust the distance therebetween so that the size of the rectangular opening formed by adjacent parallel members of the first and second sets was adjustable. The removable fastening means was disposed at each cross over point between the first and second sets for interconnecting the members together.

Another patent was U.S. Pat. No. 4,371,369, patented Feb. 1, 1983, by V. L. Wright III, which provided a stripping die assembly for a stripper in an in-line flat-bed press die cutting system, which was prepared for installation in the press as an assembly, and which was prepared for removal from the press as an assembly. Upon installation, the stripping station of the press was essentially closed to enable securing the stripping die to its stationary support, and the movable template was secured to its support before any disassembly of the stripping die from the template. After attachment to the respective press machine stripping station members, fasteners were removed to enable separation of the stripping die from the template, in perfect alignment. Following completion of a run of die-cut products the stripping station was again closed to the stripping position. Then the stripping die and template were again secured together while still being attached to the press and in perfect alignment. After being secured together, they were disconnected from the stripping station of the press and returned to storage in exact alignment with each other, ready for installation the next time pieces were needed of the same die-cut pattern.

Yet another patent was U.S. Pat. No. 4,452,495, patented Jun. 5, 1984, by R. J. Huff, which provided a stripper apparatus with a frame assembly, a plurality of stripper tracks which was positionably associated with the frame, a plurality of pin support brackets which was associated with each track and a stripper pin and pin fastener which were associated with each bracket. Each of the tracks had elongated longitudinal slots, and each support bracket was of minimum width and was arranged for adjustable association with the track and for ready positioning of the pin assembly. Thus the apparatus included upper and lower frame units and an aperture table unit lying between the frame units and adapted to lie beneath and support a cardboard sheet in which apertures have been precut but not separated from the cardboard sheet and to be positioned so that said sheet and table apertures are in registry with each other. The apparatus included a plurality of upper and lower pin mounting tracks. The upper tracks lay parallel to each other and said lower tracks lay parallel to each other. Each of said tracks had a plurality of elongated slots, and a plurality of pin support brackets associated with at least some of the tracks. The brackets included vertical and horizontal flanges, with the vertical flanges being adapted to receive fasteners passing through the slots in the tracks for adjustable positioning of the brackets. The horizontal flange of the brackets included an opening extending vertically therethrough and receiving a fastener for positioning an associated stripping pin assembly. A stripping pin assembly was associated with each of the support brackets, the pin assembly having means on one end for receiving the fasteners, as well as a shank portion and a pin portion having a flat end face forming one end thereof with the other end of the pin being received in said shank. The horizontal flange of the pin supporting bracket was constructed and arranged so that the width and length of the horizontal flange was less than one and one-half times the diameter of the shank of said pin assembly.

Yet another patent was U.S. Pat. No. 4,489,499, patented Dec. 25, 1984, by A. P. Frissora, which provided an alignment apparatus for aligning a selected object with respect to a top-dead-centre portion of a cylindrical roll which included a support base that was adapted to mount on a peripheral, circumferential surface of the roll and over the top-dead-centre portion thereof. A level indicator mechanism was mounted on the base to indicate the orientation of the base. An outer frame was pivotally mounted on the base to pivot about an outer gimbal axis. An inner frame was pivotally mounted in the outer frame and was adapted to rotate about an inner gimbal axis. The inner gimbal axis was oriented substantially-perpendicular to the outer gimbal axis. A positioning plate was movably mounted within the inner frame and was adapted to move along a reference plane defined by the inner frame. A follower mechanism was connected to the positioning plate to align the positioning plate with a selected portion of the selected object. Finally a reference mechanism indicated the relative alignment of the positioning plate with respect to the top-dead-centre of the cylindrical roll.

Another such patent was U.S. Pat. No. 4,494,455, patented Jan. 22, 1987 by G. Schoch, which provided a device for preparing a die member of a platen press to have recesses in registry with tools of a punch member, and which included a pressing station with means for receiving a stack of members including at least one backup member, a die member and the punch member. The pressing station had means for applying pressure to the stack at least to transfer an outline of the tools of the punch member to the surface of the die member. A loading station included means for loading and unloading a member of the stack into and out of the loading station. The loading means included means for positioning each of the members in the desired orientation. The device also included transport means for moving the stack between the pressure station and the loading station. The transport means included a plate receiving this tack and which was movable between the stations so that, after loading the stack on the plate, the transport leans transported the stack and plate into the pressing station. The means for pressing applied pressure to cause a transfer of the outline of the tools of the punch member onto a surface of the die member.

Another patent was U.S. Pat. No. 4,913,016 patented Apr. 3, 1990, by P. Frei, which provided a waste stripping tool comprising a grid which was formed of crossbar members consisting of a crossbar assembly of two members held side-by-side by a coupler. The assembly consisted of a strap, which had two jaws having two triangular profiled teeth which engaged in grooves in each of the crossbar members and which had a threaded arrangement for causing a clamping of the jaws onto the members to hold them in a side-by-side relationship.

A still further patent was U.S. Pat. No. 5,179,882, patented Jan. 19, 1993, by T. Takouchi et al., which provided a waste removing apparatus for removing waste portions from a production region of a cardboard sheet along punch lines on the cardboard sheet, which includes a first cutting die for engaging the cardboard sheet for removal of waste portions from the product region thereof therefrom, the first cutting die having a first holding plate for holding the product region of the cardboard sheet, the first holding plate having a predetermined configuration corresponding to the shape of the product of the region. The first holding plate also had flat planar surfaces for uniformly applying pressure to the product region of the cardboard sheet for holding the cardboard sheet securely. A second cutting die, having a base plate, was provided for engaging the cardboard sheet together with the first cutting die to remove the waste portions from the product region of the cardboard sheet, the second cutting die comprising a second holding plate for holding the product region of the cardboard sheet. The second holding plate had flat planar surfaces for uniformly applying pressure to the product region of the cardboard sheet for holding the cardboard sheet securely therebetween when the waste portions were removed, the second holding plate having a predetermined configuration corresponding in to the shape of the desired product region and corresponding to the configuration of said first holding plate. It was movably mounted on the second cutting die and had biasing means for resiliently biasing the second holding plate toward the first holding plate when the first and second holding plates are engaged. It was movably connected to the base plate. The biasing means included elastic members which were disposed between the second holding plate and the base place.

Another patent was U.S. Pat. No. 5,322,202, patented Jun. 21, 1994, by G. Pelletier, which provided an apparatus for removing a plurality of paper sheet portions from a plurality of pressing sheets, where the sheet portions were arranged in a predetermined pattern in the pressing sheets, and wherein the apparatus includes a frame. The removal apparatus included a press plate which was slidably mounted to the frame and which had a plurality of press members for pressing the sheet portions and thereby removing the sheet portions from the pressing sheets. The press members projected from said press plate and were arranged in a predetermined pattern corresponding generally to the predetermined pattern of the sheet portions in the pressing sheets. A die plate was mounted to the frame in a space relation with said press plate. The die plate had a support surface which was formed with a plurality of openings therein, the openings being of a shape generally conforming to the shape of the sheet portions in the pressing sheets. Means were provided for moving the press plate along a path of movement between a first position at which the press members were spaced away from the die plate support surface, and a second position at which the press members were adjacent the openings which were formed in said die plate support surface so that, when the pressing sheets were positioned on the die plate support surface, the press members engaged the sheet portions for pressing the sheet portions to remove them from the pressing sheets and into the openings. Receiving and collecting means positions were provided for receiving the sheet portions from the openings in the support surface as aligned stacks and for collecting the stacked sheet portions. Such means included a receiving plate which was mounted on the frame beyond the die plate and which was positioned for receiving stacks of aligned sheet portions which were removed from the pressing sheets. It further included means for moving the receiving plate responsive to movement of the press plate along a predetermined path between a first position which was adjacent to the die plate for receiving the sheet portions as they were removed from the openings in the die plate support surface, and a second position in which the receiving plate was spaced away from the die plate for removal of the sheet portions from the receiving plate. The receiving plate moving means included pressurized piston and cylinder means which were mounted to the frame intermediate to the receiving plate and the frame, thereby allowing the receiving plate to move along its predetermined path. Control means were provided for initiating movement of the receiving and collecting means responsive to movement of the press plate, the control means including a sequencing valve.

U.S. Pat. No. 5,402,698, issued Apr. 4, 1995 and assigned to Die-X Tooling Systems provided a method for aligning the tools of a typical box blank die cutting machine which contemplated the use of alignment openings on the surface of male and female tools corresponding to a cut through-hole on test sheet. As the test sheet was urged through the stages of the machine, a series of alignment cylinders was used to insure that each of the male and female tools and test sheet were aligned by having the alignment cylinders fall clearly through the various alignment openings and through-hole. Once the tools at each position of the process were aligned, alignment screws and alignment members on the machine frame serve to fix the position of the tools relative to the position of the sheets to be die-cut, stripped and blanked. Accordingly, the method contemplated alignment and set-up of the machine based upon the urged position of the sheets to be scored and cut.

SUMMARY OF THE INVENTION

(i) Aims of the Invention

While many of the above patents alluded to the solving of the problem of aligning the male blanking die with the female blanking die, with the die-cut carton blanks then being pushed through the female blanking die onto a stack of cartons below, in practice, such problem has not yet been satisfactorily solved. Thus, there is still a need for accurately aligning the male blanking die with the female blanking die, as well as guiding and supporting the blanked cardboard sheets in a fixed orientation prior to the blanked cartons being discharged from the blanking machine to a pallet for transfer.

Accordingly, one object of the present invention is to provide a means and method for accurately aligning a male blanking die with a female blanking die in a die cutting machine.

Another object of the present invention is to provide a means for supporting and guiding a blanked cardboard sheet which has had its side edges removed as it is automatically urged to a blanking station.

Yet another object of the present invention is to provide a system whereby a male blanking die and a female blanking die are carefully aligned so that the cut cardboard carton blanks, which are free from any remaining extraneous material, are accurately pushed through openings in the female blanking die onto a stack of cartons therebelow.

Still another object of the present invention is to provide an improved female blanking die.

Yet still another object of the present invention is to provide an improved male blanking die.

Still another object of the present invention is to provide a method for producing an improved female blanking die.

Still another object of the present invention is to provide a method for producing an improved male blanking die.

(ii) Statements of the Invention

By an embodiment of this invention, a universal press frame is provided for a die cutting machine for die cutting and/or blanking a carton blank, the universal press frame comprising a rectangular framework, and a plurality of jogger members which are selectively disposed along the interior perimeter of the rectangular framework, each jogging member comprising a base member, an adjustable support member which is adjustably-slidably disposed along a longitudinal axis of the base member, and a guiding member having an upper edge and a lower edge, the guiding member being secured to one face of the adjustable support member to provide a depending guiding face to which the jogging member is secured, whereby the plurality of jogger members are oriented along the interior perimeter of the rectangular framework in such a way that an imaginary perimeter which would be defined by joining the guiding faces of the guiding members constitutes a perimeter that is substantially-identical to the outer perimetrical shape of a sheet of cardboard containing a plurality of the carton blanks which have been die-cut by a male cutting due of the die cutting machine.

GENERALIZED DESCRIPTION OF THE INVENTION

As noted hereinabove, the system of one important embodiment of this invention provides a female blanking die in the form of a grid support frame which is accurately positioned within the universal press frame. The female blanking die is accurately positioned within the universal press frame by means of a template which had been laser-shaped corresponding to the outer perimetrical shape of a sheet of cardboard containing a plurality of cartons which are to be die-cut by the male cutting die of the die cutting machine. The perimetrical edges of the layered template is used to define the extent to which the jogger members of other embodiments of this invention project inwardly within the interior perimeter of the rectangular framework of the universal press frame. The perimetrical shape of the template and the rectangular apertures therethrough, are produced according to the instructions of a CAD program and then are laser cut. The outer perimeter of the template is about 1/32" outside of the carton cut lines which have been accurately laser etched into the template according to the instructions of the CAD program. The inside laser etched lines are on-size to match the outer perimetrical shape of the cartons to be die-cut by the die press. Holes are laser-cut in the template in precise locations according to the instructions of the CAD program. T-nuts are secured within the holes and the bases of the orientation devices are threaded into the T-nuts. The orientation devices are in the form of cylinders including an upper barrel having a slot in its upper circular face and a threaded shank at the base thereof. These orientation devices are used to fix the location of the female blanking die grid. In addition, etch lines are provided on the central line of the template, and laser-cut holes are provided along the central line. T-nuts are secured within the holes and additional similar orientation devices are threaded into the T-nuts. The template is temporarily, but securely, fixed to the frame by means of engagement with template mounting blocks which are disposed on the two opposed side rails of the universal press frame. The template is adjusted to be on the centre line of the universal press frame and is adjusted to datum positions which have been previously designated according to the instructions of the CAD program, with respect to the side rails. This provides a rigid, stable combination of the universal press frame and the template.

The grid, in the shape of the outline of each of the abutting portions of the plurality of cartons to be die-cut, (and which forms the female blanking die) is placed atop the template to fit into the slots within the orientation members, and into slots in grid support brackets which are also disposed along the internal periphery of the universal press frame. The barrels of the orientation cylinders are rotated so that the grid fits onto the slots of the orientation members, and then the orientation members are locked into the template by means of the lock washers. The ends of the grid are locked to respective grid support brackets by a lock screw and the grid support brackets are then slid along the universal press frame to the proper position according to the instructions of the CAD program. The grid support brackets are then locked in accurate positions on the universal press frame, dependent on the accurate location of the grid. In this way the grid is placed in the perfect position according to the instructions of the CAD program for accurate positioning of the female blanking die.

The jogger members are now accurately positioned around the upper perimeter of the universal press frame. Some or all of the jogger members may have been previously placed around the inner perimeter of the universal press frame before the template is secured therein. If not, all the jogger members are placed at this time. In any event, jogger members which are selectively disposed along the interior perimeter of the rectangular framework of the universal press frame are adjusted to abut selected perimetrical edges of the lasered template. In this way, the jogger members are thereby accurately positioned.

If the back trim of the die-cut sheet of cardboard containing the plurality of cartons has been removed by the stripper, the jogger members are adjusted to abut the back of the layered template. If the side trim has been removed of the die-cut and blanked sheet of cardboard containing the plurality of cartons has been removed by the stripper, side rails are inserted into slots in the side jogger members, or alternatively, in special side support brackets, and are secured therein with lock-down bolts. This provides support for the side edges of the blanked sheet of cardboard.

The front end of the blanked sheet of cardboard is associated with a gripper. The front trim is removed to provide the means to pull the blanked sheets of cardboard through the press. A front trim support system, whose profile has been predetermined according to the instructions of the CAD program to the exact jogging position, rests on a support bracket and on the grid. The front trim support is longitudinally-adjustable to set a distance which provides the shear for breaking the nicks in the blanked sheet of cardboard, and is used to draw the sheet of cardboard through the press.

By these means, the entire female blanking die, which includes the grid, is built up. The template assures that the cut sheet of cardboard is exactly matched and that the universal press frame is square. The female blanking die can be fixed in the press in registry with the datum which is predetermined according to the instructions of the CAD program.

The die-cut sheet of cardboard is supported on the grid (the female blanking die) and on the front trim support, and optionally also on the side support rails. The jogger members are adjusted (i.e., fine-tuned) to position them to contact the perimeter of the template. The front trim support is adjusted (i.e., fine-tuned) by longitudinal movement to provide the proper set-up for the shear distance.

The template is then removed by the removal of the lock screws holding the template to the template mounting blocks. The template mounting blocks are then removed, thereby allowing the template to drop down below the universal press frame. Once the template is then removed from underneath the universal press frame, the entire female blanking die and universal press frame is ready for mounting as the lower plate (female blanking die) of the blanking machine and to be ready for production.

The template now becomes the male blanking die by the following steps. The orientation devices are removed from the upper surface of the template. The lower surface of the template is provided with a plurality of foam plastic blocks which are removably secured to the underside of the template. These blocks may be removably held by means of holding members, e.g., cylindrical or T-shaped or V-shaped members which are secured to the underside of the template. Some or all of these foam plastic blocks may be split longitudinally, so that the two portions may be slid along the holding members to "fine-tune" their position, as will be explained further hereinafter. The template is then secured in the usual fashion to the die cutting machine by means well known in the art. Such securement is, however, very accurate and is in registry with the lower female blanking die through the use of the holes from which the orientation devices have been removed. The foam plastic blocks contact the blanked cartons in a manner which does not damage the cartons when the blanked-out cartons are removed from the die-cut sheets of cardboard.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

(i) BRIEF DESCRIPTION OF THE DRAWINGS

The present invention will become more fully understood from the detailed description given hereinbelow and the accompanying drawings, which are given by way of illustration only, and thus are not limitative of the present invention, and wherein:

FIGS. 18 to 21 are views of one embodiment of the jogging member of one embodiment of this invention in which;

FIG. 18 is a perspective view thereof;

FIG. 19 is front elevational view thereof;

FIG. 20 is a top plan view thereof; and

FIG. 21 is rear elevational view thereof;

DESCRIPTION OF PRIOR ART MACHINE

In order to set the proper environment for the present invention, the following is a description of a typical die cutting machine, including a blanking machine based upon the description provided in U.S. Pat. No. 5,337,639.

Figure 1:
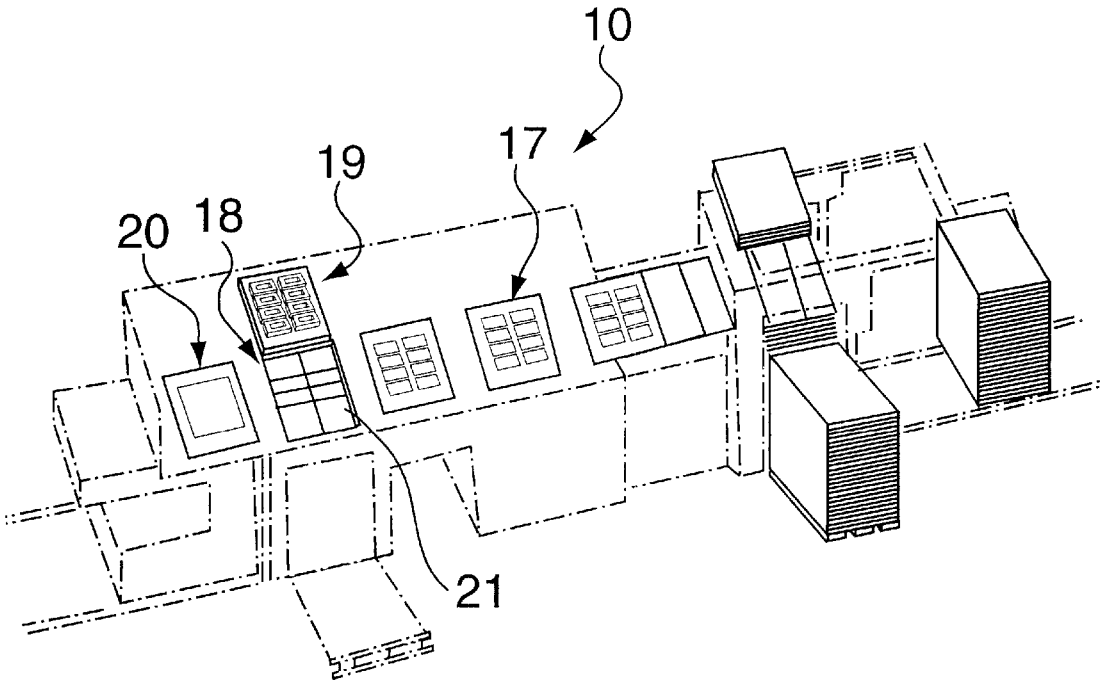
FIG. 1 PRIOR ART
FIG. 1 is a perspective view of a typical prior art die cutting machine, including a blanking apparatus.

FIG. 1 shows a die cutting press 10 for scoring, stamping, stripping and separating cardboard forms from substantially planar sheets. The blanking operation specifically includes a female blanking die portion 18 and a complementary male blanking die 19 for blanking or separating die-cut box blanks or other forms into a detached web 20 and a substantially planar and unassembled die-cut blank 21. These prior art female blanking die 18 and complementary male blanking die 19 are improved according to embodiments of the present invention, to be described hereinafter. The die-cut sheet 17 is automatically pulled through the press and over the female die portion 18, through the use of a travelling bar having appended gripper fingers which are adapted to grip the leading edge of the die-cut sheet of cardboard 17.

After blanking, web 20 remains on the face of the female die portion and includes a series of intermediate web portions which, together, form an extremely flexible and flimsy paper "skeleton" which must be removed from the female blanking die face. In actual operation, a travelling bar and appended grippers pull the flexible web over the female blanking die face, including the leading edge of the female blanking die.

In operation, a sheet of cardboard sheet is fed into the die cutting machine and is gripped at its leading edge by a gripper bar. The cardboard sheet is then "pulled" through the die cutting machine, first to the die cutting operation. During the die cutting operation, an array of blanks is stamped onto the cardboard sheet for later separation, and the die-cut sheet of cardboard is then pulled to the stripping station. At the stripping station, much of the excess and surplus cardboard on the stamped sheet of cardboard is removed. However, the die-cut blanks are held together by a thin wall or "nick". After stripping, the web and suspended blanks are next pulled to the blanking station, for separation into unattached box blanks and web portions for disposal. In particular, the stripped cardboard sheet is urged over the female blanking die portion. The cardboard sheet lies flush against the female blanking die surface. The male blanking die and attendant die members are pressed against the female die and the blanks are forced through the holes through the female cutting die and are separated from the web. Upon completion of the blanking operation, the carton blank is then pushed through proper sized holes in the female blanking die onto a pallet or stack, therebelow.

The blanking operation thus serves to separate the actual carton blanks from the suspending web portion using the upper male die/lower female die combination. The female blanking die includes a series of blanking holes, matching the profile of the die-cut lay-out of the blanked cartons. The female blanking die further provides support for the cardboard sheet or web as it crosses the upper faces of the female blanking die. The stamped sheet of cardboard is supported by the female blanking die. In the operation of the blanking dies, the upper male die is pressed downward through the corresponding through holes in the female die, thereby separating and pushing through the die-cut carton blanks through the corresponding through holes in the female die, and leaving the web on the surface of the female die.

It is then necessary automatically to remove the remaining web from the female die face portion by use of conventional travelling bar and grippers.

DESCRIPTION OF PREFERRED EMBODIMENTS

Figure 2:
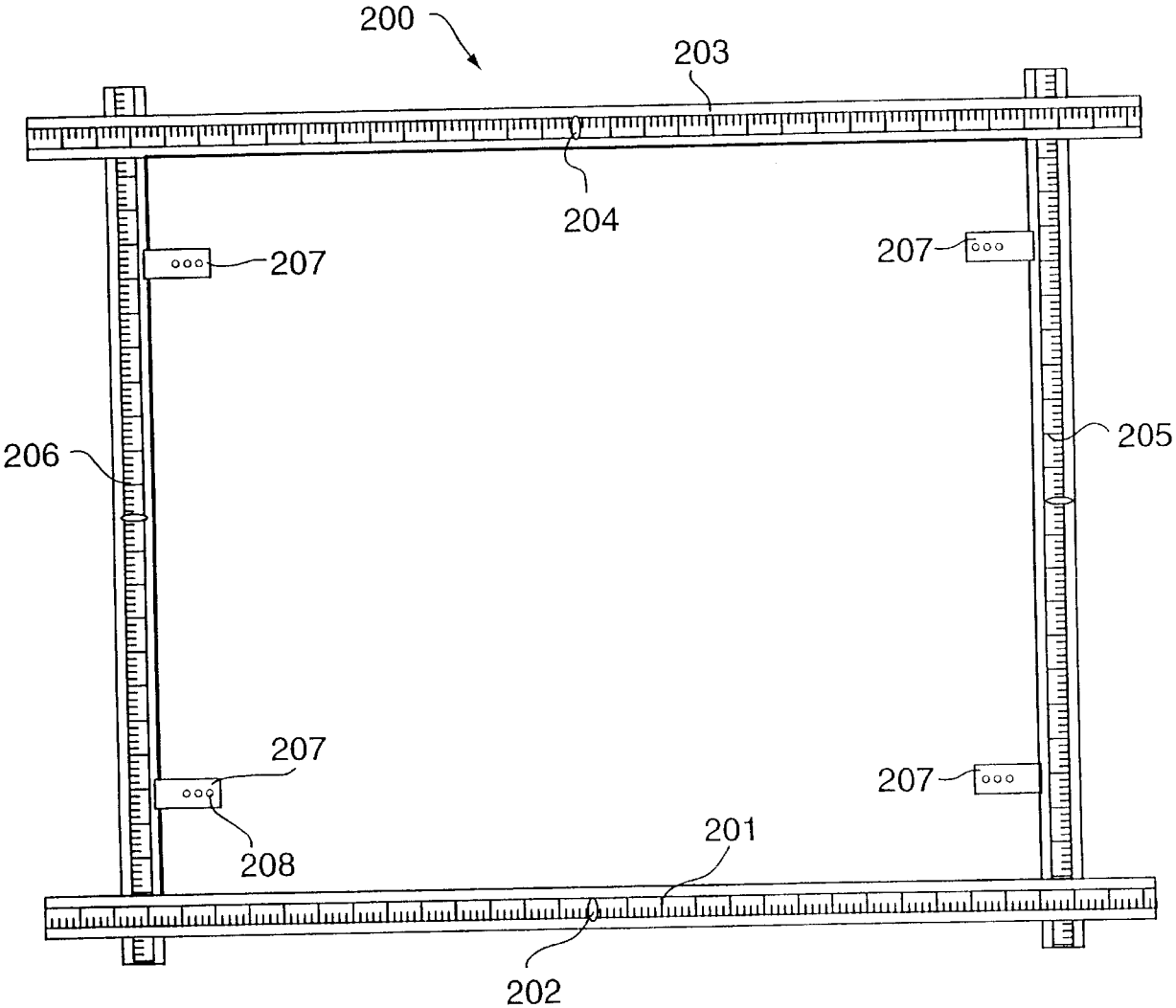
FIG. 2 is a top plan view of the universal press frame of an embodiment of this invention after the first step in the production of the female blanking die according to one embodiment of the present invention, showing the placement of the template mounting blocks.

(i) Description of FIG. 2

FIG. 2 shows a first step in the production of the female blanking die of one embodiment of the present invention. Shown are a universal press frame 200 constituted by a front rail 201, a rear rail 203, and two opposed side rails 205, 206. Opposed side rails 205, 206 are slidable transversally with respect to front rail 201 and rear rail 204, thereby to adjust the size of the rectangular size of the universal press frame. The front rail 201 is provided with a centre datum 202, and the rear rail is likewise provided with a centre datum 204. A plurality of support brackets, namely four brackets 207 are secured to the universal press frame, i.e., two brackets 207 are secured to side rail 205 and two brackets 207 secured to side rail 206. Each bracket 207 is provided with a plurality, e.g., three tapped apertures, for a purpose to be described hereinafter.

Figure 3:
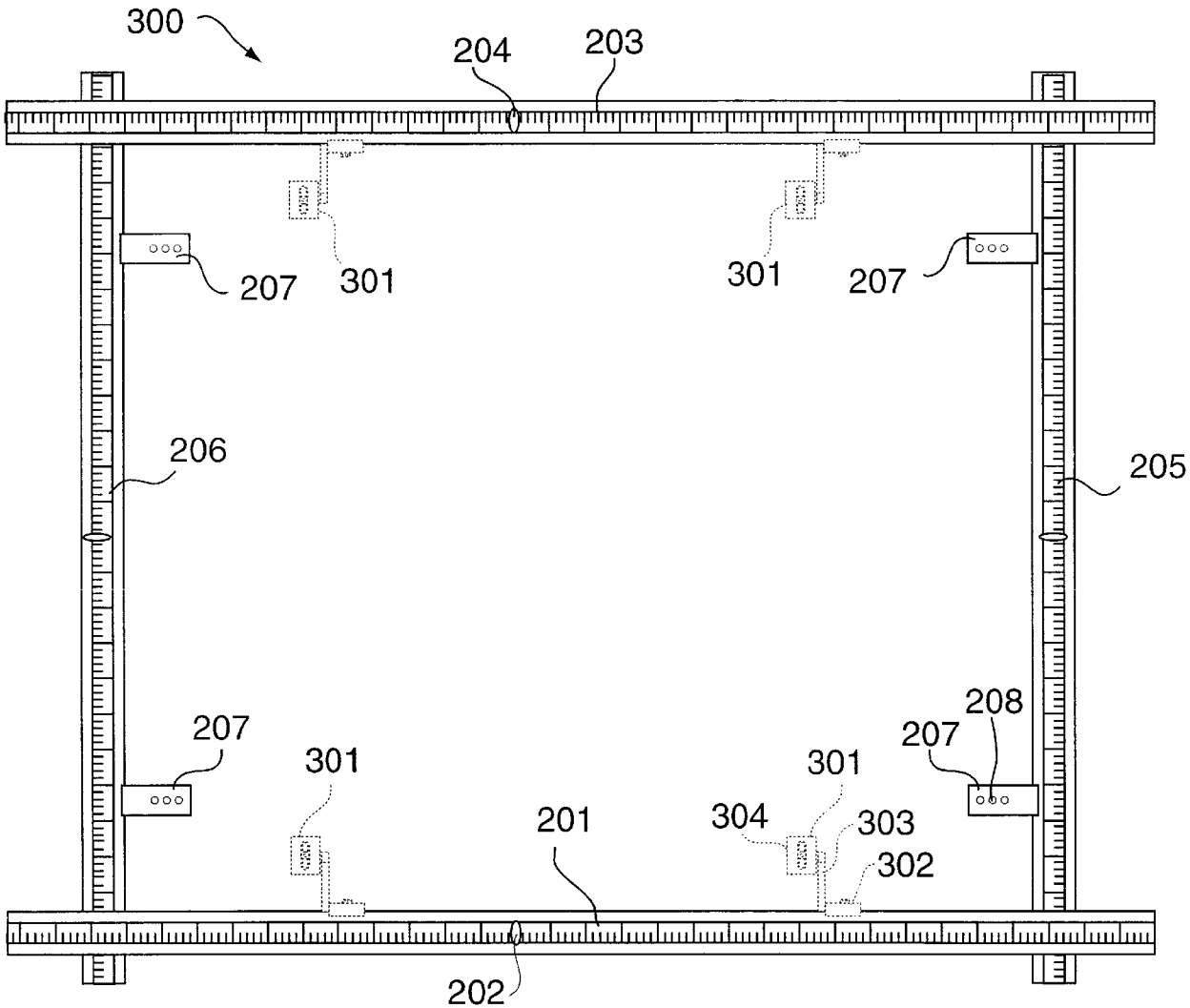
FIG. 3 is a top plan view of the universal press frame of an embodiment of this invention after an optional second step in the production of the female blanking die according to one embodiment of the present invention, thus showing the optional approximate placement of the jogger members of another aspect of the present invention.

(ii) Description of FIG. 3

FIG. 3 shows a second step in the production of the female blanking die of one embodiment of the present invention. Shown are the universal press frame 300 which is built up from the universal press frame 200 of FIG. 2, but which in addition includes jogger members 301. These jogger members 301 form another aspect and embodiment of the present invention. They include a base member 302, a support arm 303 and an adjustable support member 304, which is adjustably-slidably-disposed along the longitudinal axis of the base member 302. A full description of the jogger members will be provided with respect to FIGS. 18 to 22.

The jogger members 301 are disposed along the interior periphery of the universal press frame 300. In FIG. 3, they are shown to be disposed on this case only along front rail 201 and rear rail 203, but only in approximate location, to be finely adjusted as will be later described. In the final building-up of the universal press frame to be described hereinafter with respect to FIG. 9, the jogger members are also disposed on the opposed side rails 205,206.

Figure 4:
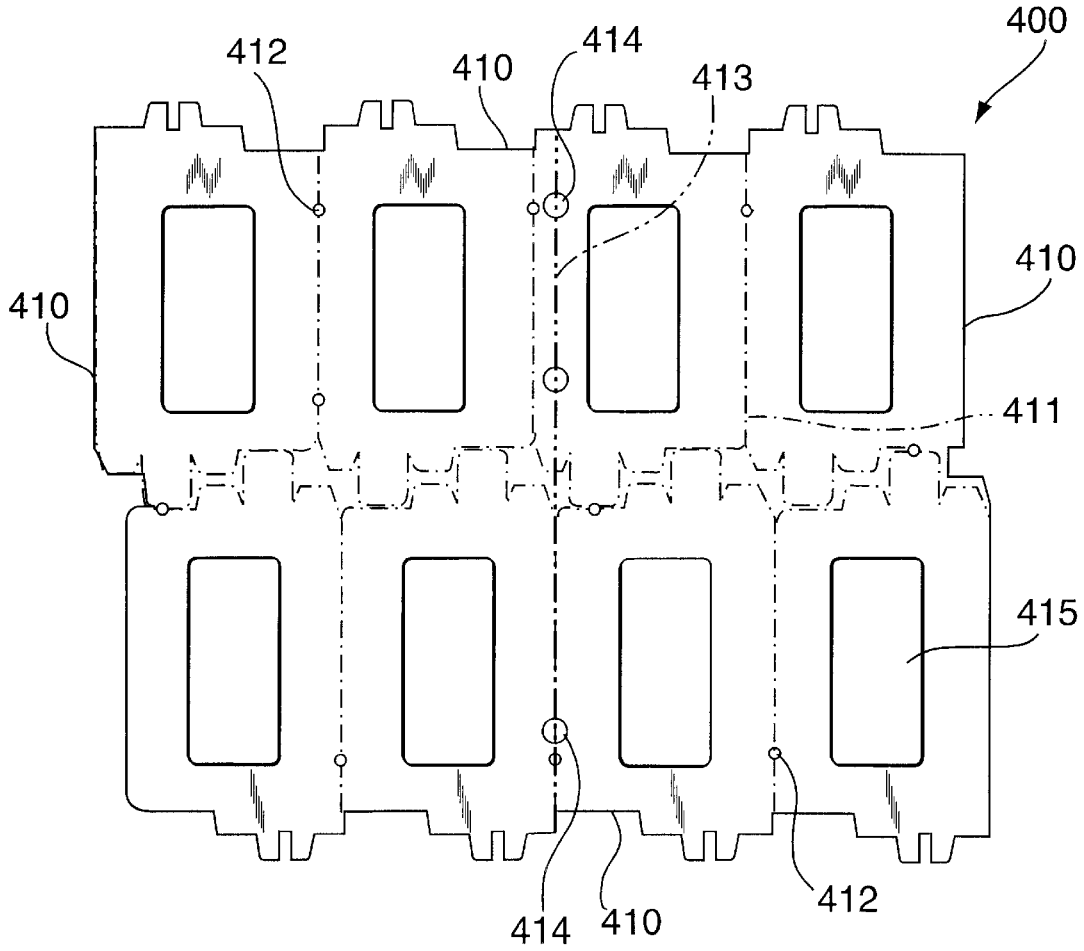
FIG. 4 is a top plan view of the template of an embodiment of this invention used in subsequent steps in the production of the female blanking die according to one embodiment of the present invention, and which will later provide the male blanking die according to another embodiment of the present invention.
Figure 5:
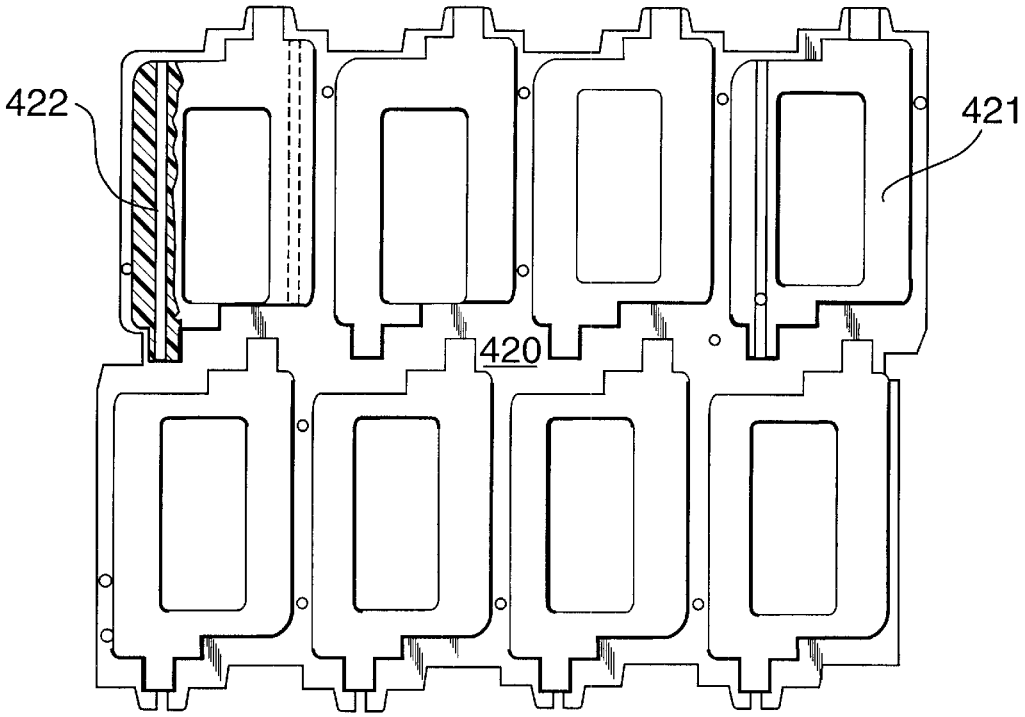
FIG. 5 is a bottom plan view of the template shown in FIG. 4, also showing the foam plastic blocks which are removably secured thereto.
Figure 6:
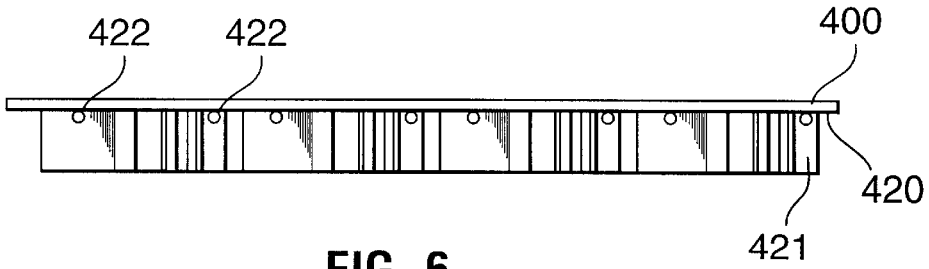
FIG. 6 is a front elevational view of the template shown in FIG. 4.

(iii) Description of FIG. 4, FIG. 5 and FIG. 6

FIGS. 4, 5 and 6, show the template 400, which in its primary function constitutes the means for accurately positioning the jogger members 301 and the means for accurately positioning a grid to be described hereinafter with respect to FIG. 11. The template is an exact duplicate of the set up and provides an easy press adjustment. It is 100% CAD datum accurate. It includes a quick mount system, which also provides an exact tool/sheath registration. Pre-press equipment is not required.

The template is produced according to the instructions of a CAD program and then is laser cut to provide a periphery 410 which coincides with the outline of the sheet of cardboard after it has been die-cut with a plurality of cartons thereon. This CAD program provides a perimetrical outline corresponding to the shape of carton blanks to be die-cut from a cardboard sheet. The perimetrical edges 410 of the lasered template 400 are used to define the extent to which the jogger members 301 project inwardly within the interior perimeter of the rectangular framework of the universal press frame 200, 300. The outer perimeter 410 of the template 400 is about 1/32" outside of the carton cut lines 411 which have been laser etched into the template 400 accurately to the instructions of a CAD program. The inside laser-etched lines 411 are on-size to match the physical shape of the cartons to be blanked by the die press. Holes 412 are laser cut in the template in precise locations as determined by the instructions of the CAD program. As will be described later with respect to FIGS. 26 and 27, T-nuts are secured within the holes 412 and orientation devices are threaded into the T-nuts. The orientation devices 401 include a cylinder having a lower threaded integral bolt, a lower threaded barrel and a slot at the upper end of the barrel. A lock nut is threaded onto the threaded barrel for a purpose to be described later.

In addition, the CAD program instructs the laser to provide center etch lines 413 on the centre line of the template 400. Laser-cut holes 414 are also provided along the centre line. As will be described with respect to FIGS. 26 and 27, and as described above for holes 412, T-nuts are secured within the holes 414 and the orientation devices as described above are threaded into the T-nuts. The template is also provided with lasered designated datum positions according to the CAD program, for a purpose to be described later.

The template is also provided with a plurality of accurately-placed, rectangular apertures 415 for a purpose to be described later.

The lower surface 420 of the template 400 is provided with a plurality of foam plastic blocks 421 which are removably secured to the underside 420 of the template 400. These blocks 421 are provided in the shape of the cartons to be die blanked, and include the apertures 415. The blocks 412 are removably held to the template 400 by means of holding members, e.g., cylindrical, or T-shaped, or V-shaped, members 422 which are secured to the template 400.

While all the foam plastic blocks 420 are shown as unitary blocks, a further embodiment of this invention teaches that at least some of the foam plastic blocks are divided transversely into two longitudinally slidable blocks. These subdivided foam plastic blocks may be slid longitudinally in order to adjust the offset between the foam blocks and the openings in the female blanking die. This, thereby, enables adjustment of the shear for breaking the nicks in the sheet of cardboard containing the plurality of carbon blanks which have been die-cut by the die cutting machine.

Figure 7:
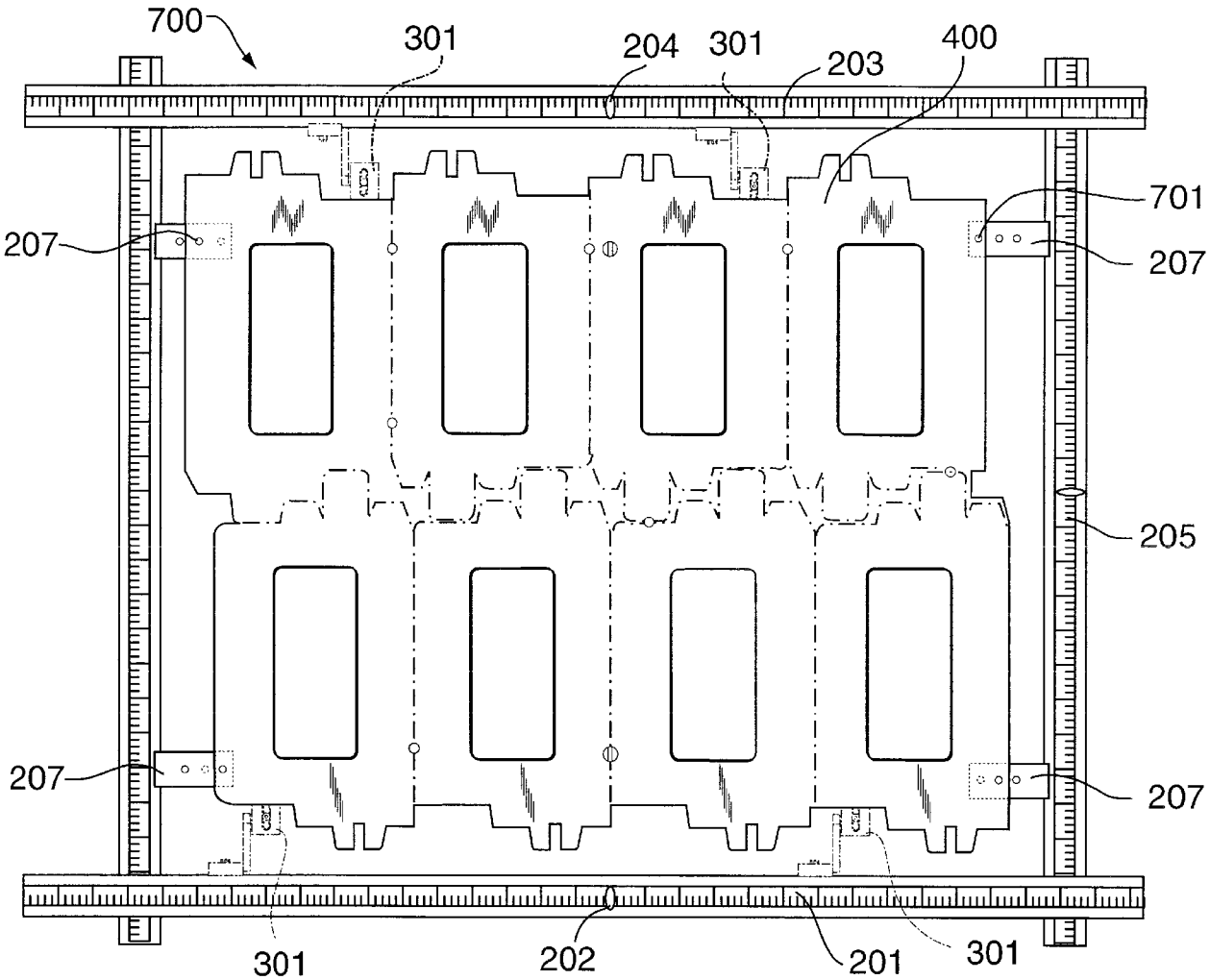
FIG. 7 is a top plan view of the universal press frame of an embodiment of this invention after a third step in the production of the female blanking die according to one embodiment of the present invention, also showing the placement of the template shown in FIG. 4 on the template mounting blocks.

(iv) Description of FIG. 7

FIG. 7 shows the third step in the production of the female blanking die of one embodiment of the present invention. In this step, the universal press frame 700 is fitted with the template 400. The template 400 is placed atop the template mounting blocks 207, is accurately secured thereon according to datum positions controlled by the CAD program, by means of screws 701.

Figure 8:
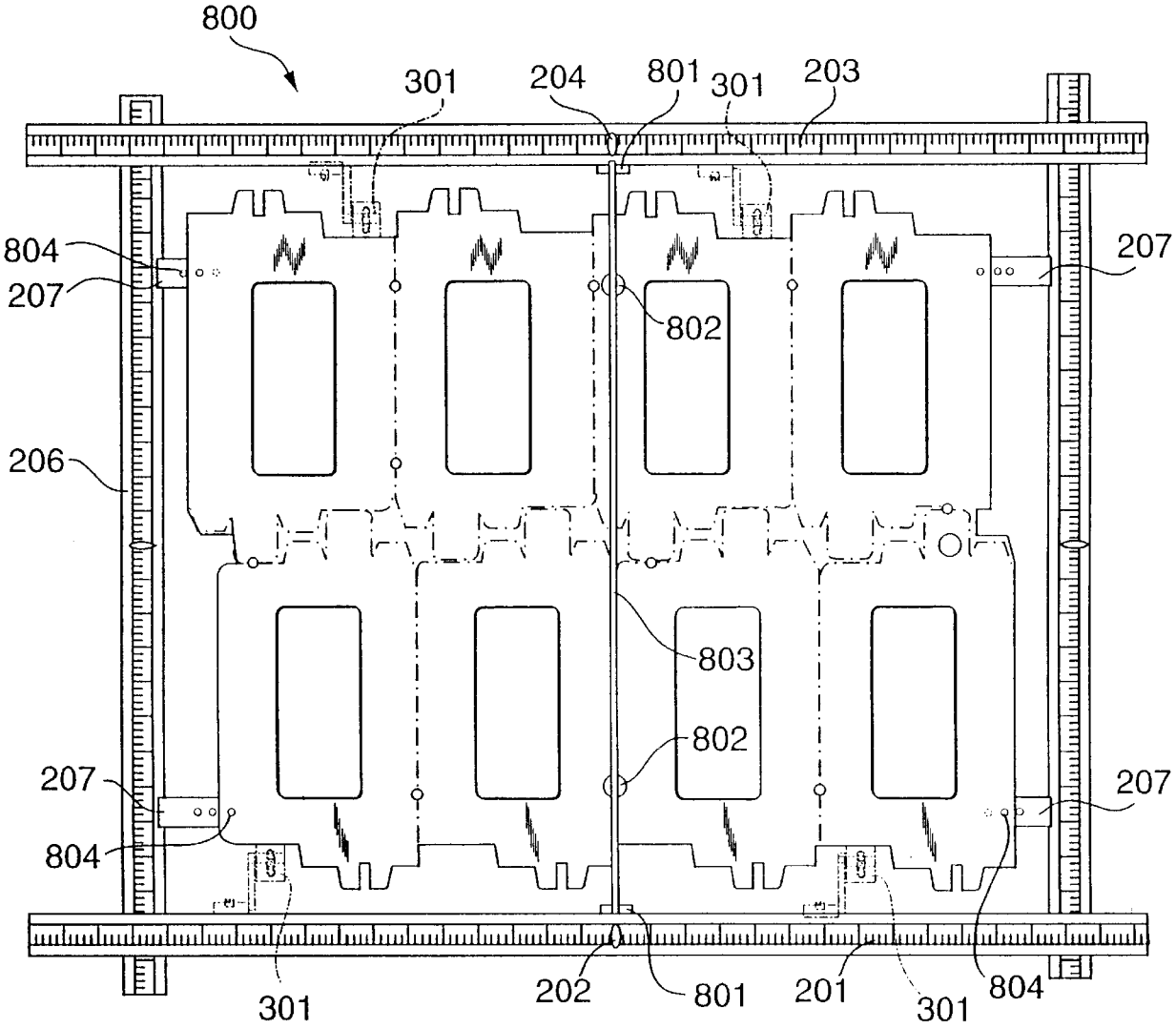
FIG. 8 is a top plan view of the universal press frame of an embodiment of this invention after a fourth step in the production of the female blanking die according to one embodiment of the present invention, also showing the placement of the centre rule for the accurate placement of the template shown in FIG. 4 on the universal press frame.

(v) Description of FIG. 8

FIG. 8 shows the fourth step in the production of the female blanking die of one embodiment of the present invention. In this step, centering brackets 801, which includes slots therein, are placed at the centre point 202 of the front rail 201 and the centre point 204 of the rear rail 203 in the universal press frame 800. Centering orientation devices 802 (which are the same as orientation devices 401) are inserted in a manner as previously described, into the template 400 along the center line 413. Then, a centering rule 803 placed in the slots in the centering bracket 801 and slots in the centering devices 802. By these means, the template 400 is properly centred. Then the template 400 is also adjusted forwardly or backwardly according to the datum points as defined by the CAD program. The template 400 is now firmly secured to the support brackets 207 by means of screws 804 which are inserted into the appropriate apertures 208 in the associated template mounting block 207.

Figure 9:
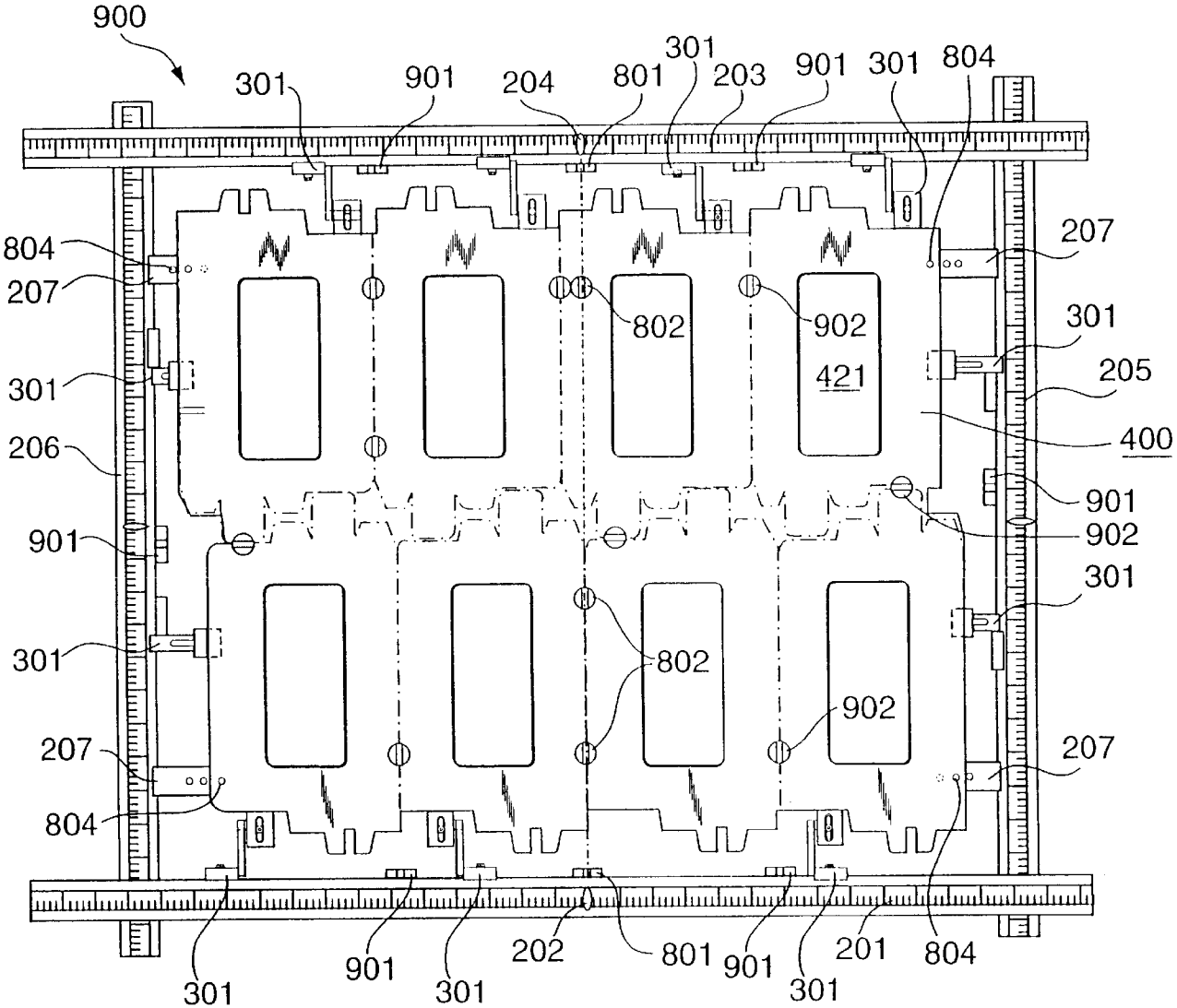
FIG. 9 is a top plan view of the universal press frame of an embodiment of this invention after a fifth step in the production of the female blanking die according to one embodiment of the present invention, also showing the placement of all the orientation devices, the jogger members and the grid support brackets.

(vi) Description of FIG. 9

FIG. 9 shows the fifth step in the production of the female blanking die of one embodiment of the present invention. In this step, since the template 400 is now accurately secured within the universal press frame 900, all the jogger members 301 are now accurately positioned and secured to the entire interior perimeter of the universal press frame 900, i.e., to front rail 201, to rear rail 203 and to the opposed side rails 205,206, so that the guiding members thereof abut selected portions of the perimeter 410 of the template 400. In addition, a plurality of grid support brackets 901 are disposed along the interior periphery of the universal press frame 900.

Figure 10:
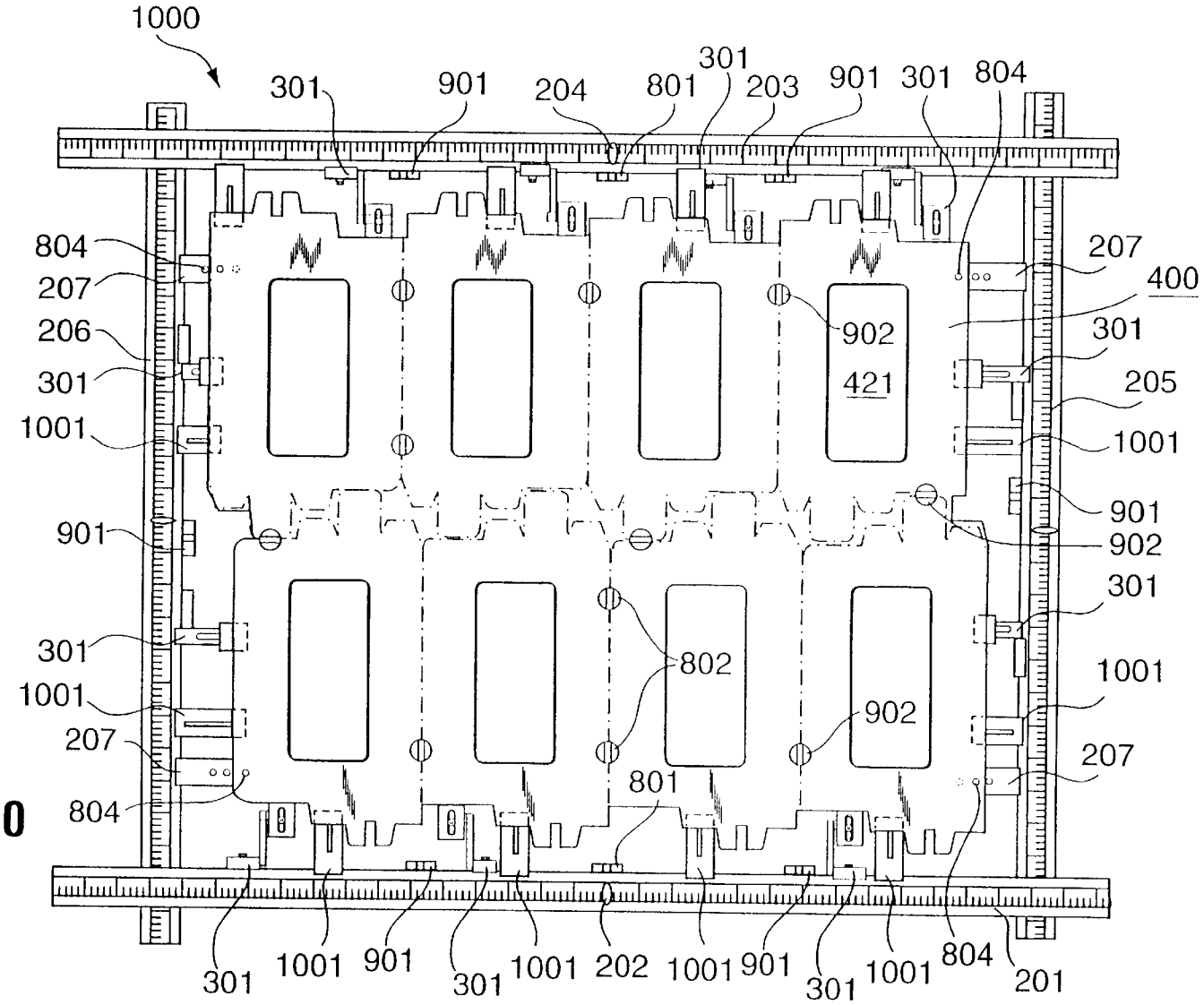
FIG. 10 is a top plan view of the universal press frame of an embodiment of this invention after a fifth step in the production of the female blanking die according to one embodiment of the present invention, also showing the placement of the auxiliary support tables.

(vii) Description of FIG. 10

FIG. 10 shows the sixth step in the production of the female blanking die of one embodiment of the present invention. In this step, a plurality of auxiliary support tables 1001 are disposed around the interior periphery of the universal press frame 1000. These tables 1001 are adjusted so that their leading edges extend a small distance, e.g. about 1/16",inwardly of the periphery 410 of the template 400 for a purpose to be described hereinafter.

Figure 11:
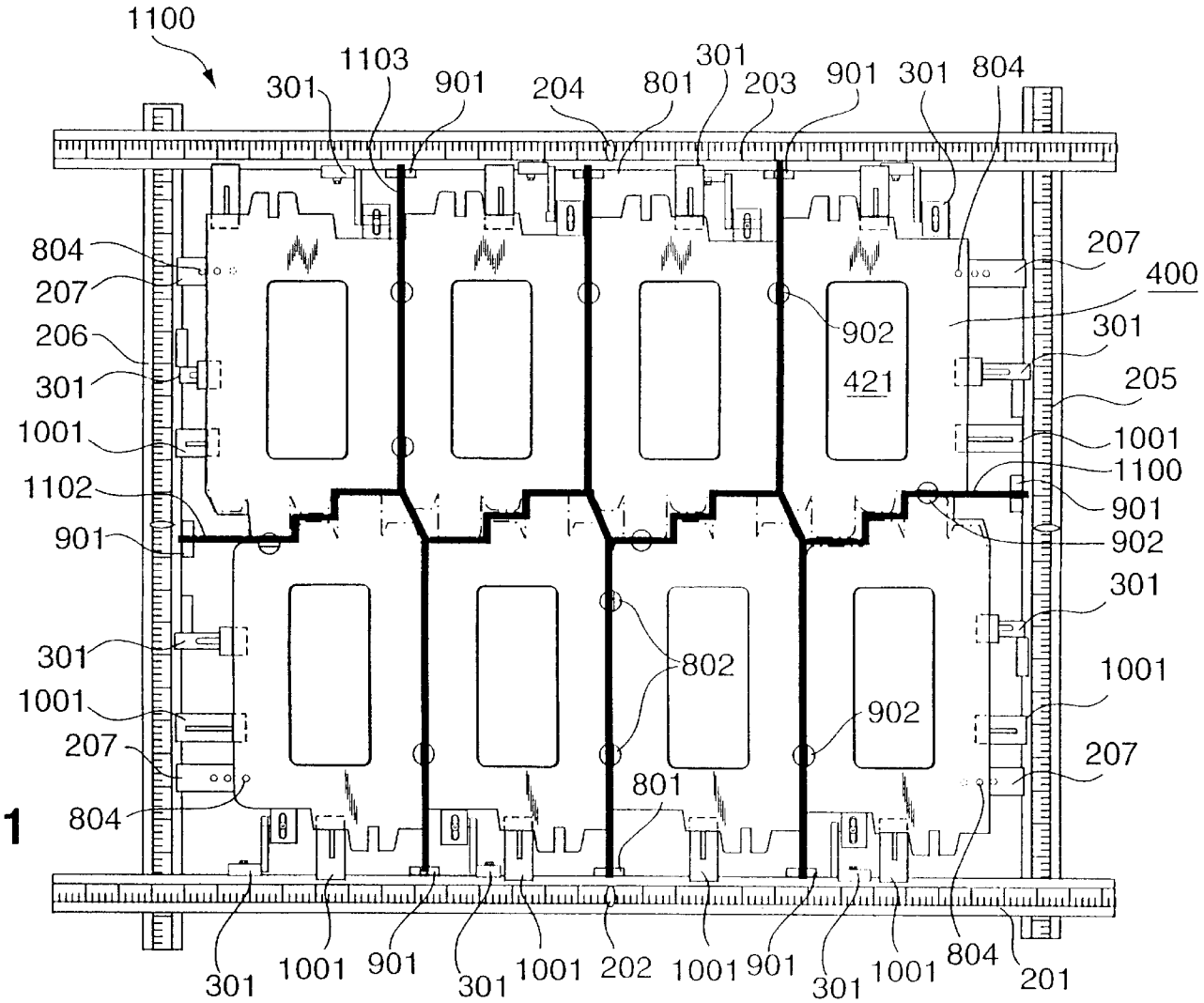
FIG. 11 is a top plan view of the universal press frame of an embodiment of this invention after a sixth step in the production of the female blanking die according to one embodiment of the present invention, also showing the placement of the grid atop the template.

(viii) Description of FIG. 11

FIG. 11 shows the seventh step in the production of the female blanking die of and embodiment of the present invention. In this step, the grid 1101, whose transverse rail 1102 and longitudinal rail 1103 rail coincide exactly with the laser-etched shape of the abutting portions of the plurality of cartons which are to be die blanked from the sheet of cardboard. The grid 1101 is disposed so that it fits within the slots in the upper surface of the cylindrical devices 414 in the template 400 and in the slots in the grid support brackets 901. Once this disposition has taken place, the grid support brackets are finely adjusted to locate the grid 1103 accurately within the universal press frame 1000 and the grid support brackets are secured in place.

Figure 12:
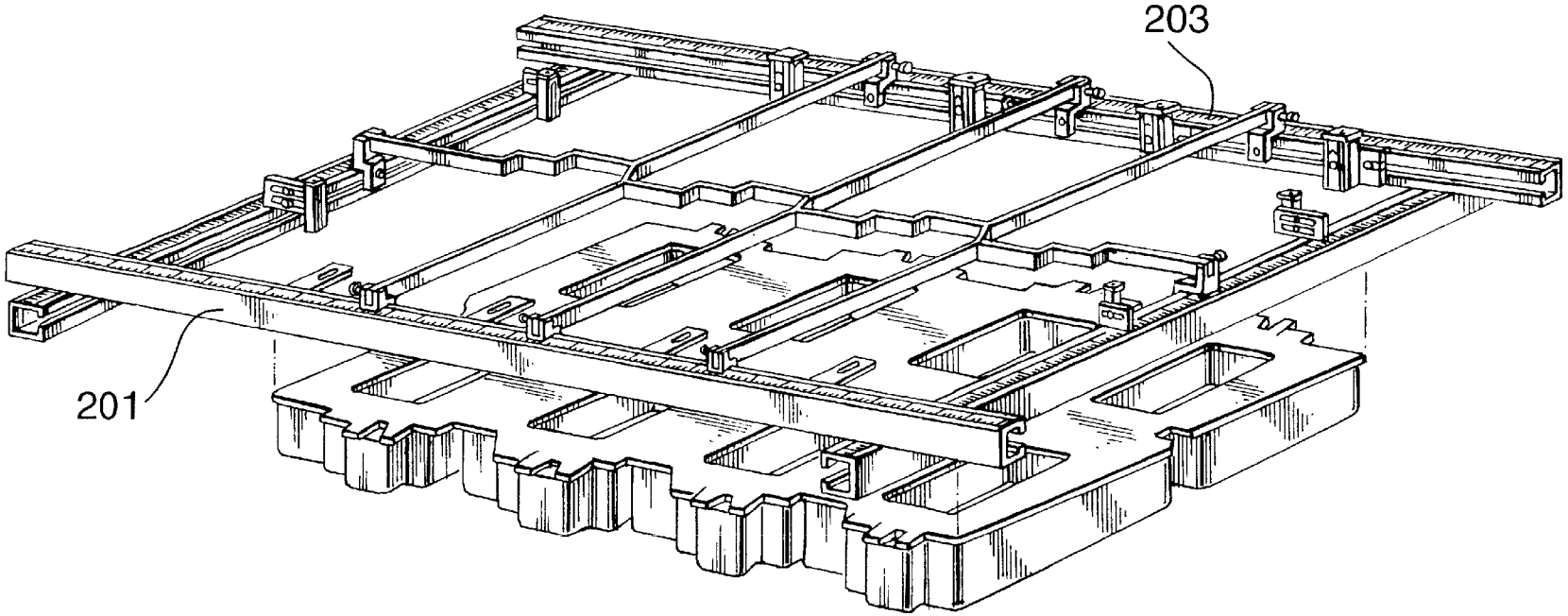
FIG. 12 is a perspective view of a seventh step in the production of the female blanking die of one embodiment of the present invention, showing the removal of the template.

(ix) Description of FIG. 12

FIG. 12 shows the eighth step in the production of the female blanking die of one embodiment of the present invention. In this step, the screws 901 are removed from the apertures 208 in the template mounting blocks 207, and the lock screws or lock bolt holding the template mounting blocks 207 to the universal press frame 1100 are also removed. This allows the template 400, but not the grid 1001, to drop down below the universal press frame 1100. As shown in FIG. 12, the template has been lowered completely from both the rear rail 203 and from the front rail 201. The removed template 400 is then used to provide the upper male blanking die as described hereinafter.

Figure 13:
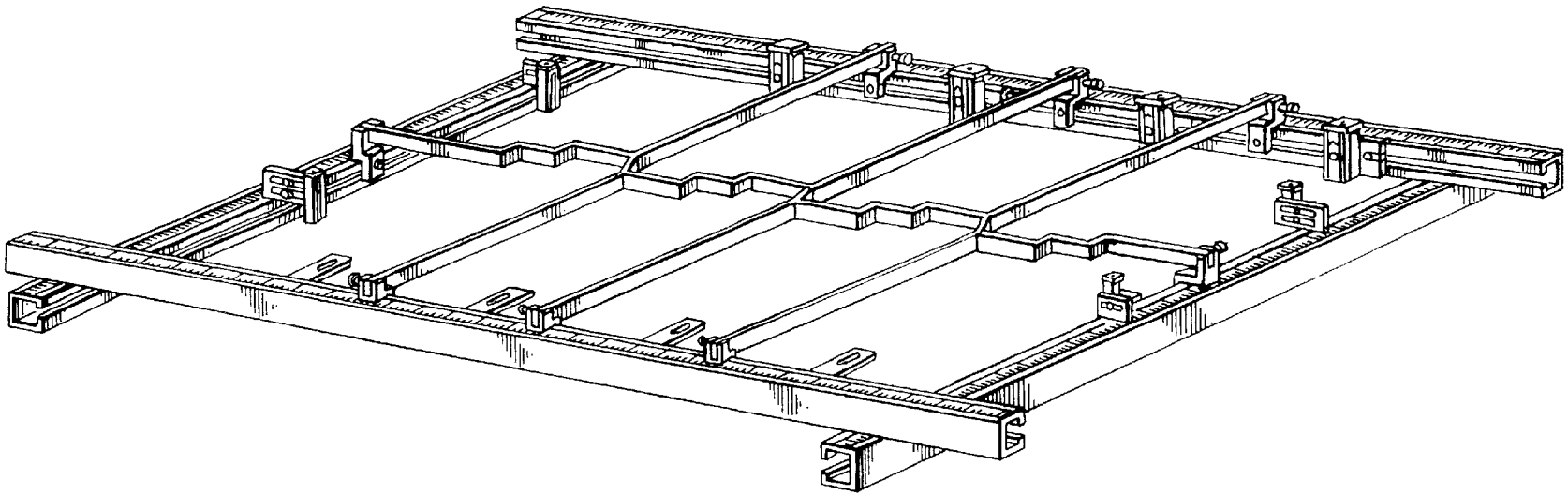
FIG. 13 is a perspective view of the female blanking die according to one embodiment of the present invention.

(x) Description of FIG. 13

FIG. 13 shows one embodiment 1300 of the female blanking die of one embodiment of the present invention. This includes the universal press frame 1100, the grid 1101, the jogger members 301 and the auxiliary support tables 1001. The grid 1101 is positively and accurately secured within the universal press frame 1100 by means of the grid support brackets 901.

Figure 14:
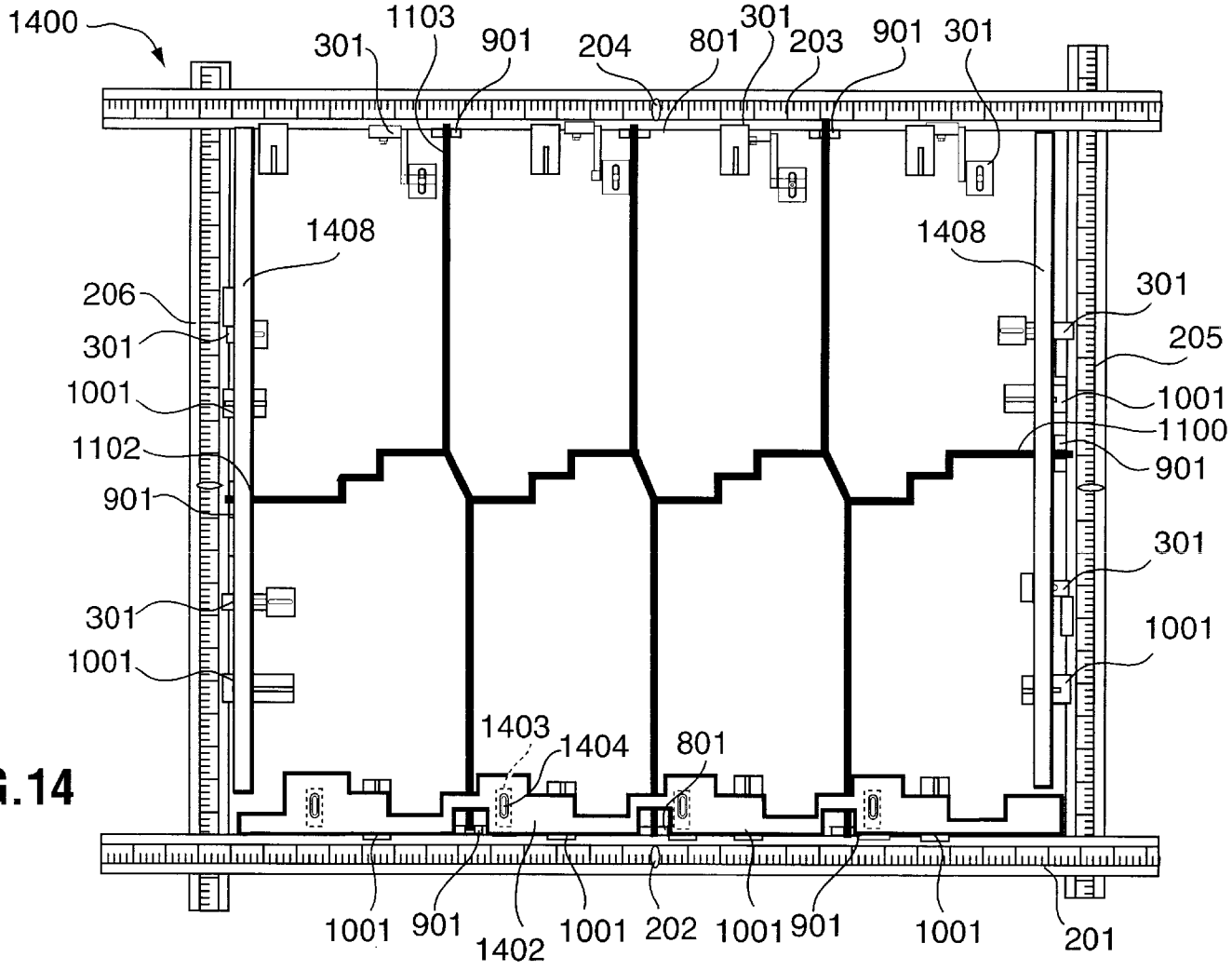
FIG. 14 is a top plan view of the female blanking die according to another embodiment of the present invention also showing the side support rails and the front trim support.

(xi) Description of FIG. 14

FIG. 14 shows a second embodiment 1400 of the female blanking die of one embodiment of the present invention. In this embodiment, a front trim support member 1401 is secured to the front rail 201 of the female blanking die 1300.

Figure 15:
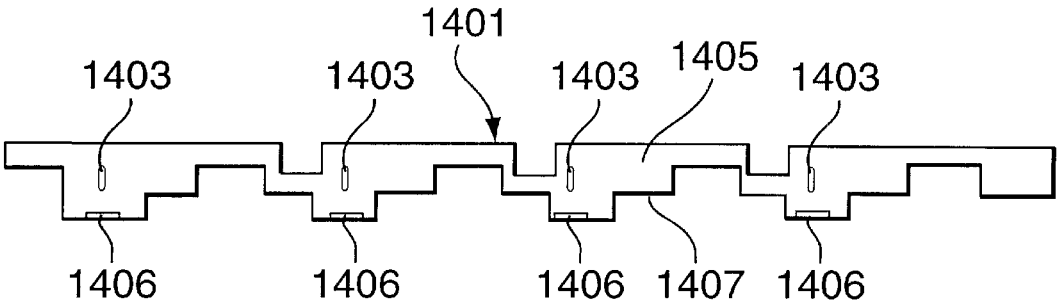
FIG. 15 is an underside plan view of the front trim support first shown in FIG. 14.
Figure 16:
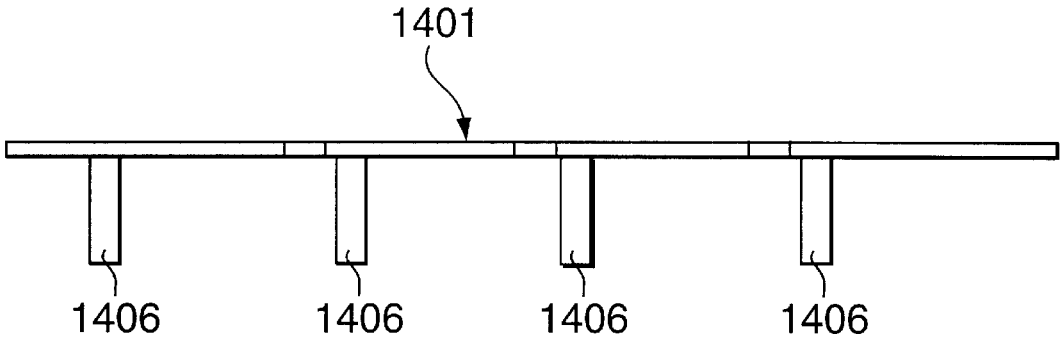
FIG. 16 is a front elevational view of the front trim support first shown in FIG. 14.

(xii) Description of FIG. 15 and FIG. 16

FIGS. 15 and 16 are more detailed views of the front trim support member 1401. The front trim support member 1401 has a profile 1402 which has been predetermined by the CAD program to the exact profile position of the leading edge of the blanked sheet of cardboard with the plurality of cartons blanked thereon. It includes longitudinally-extended slots 1403 to enable securement to a front trim support bracket 1404. The underside 1405 of the trim support member 1401 system is fitted with downwardly-depending jogger fingers 1406 at the leading edge 1407 of the front trim support 1401. The front trim support member 1401 is then able to be moved longitudinally forward or backwards to provide the shear which is necessary to break the nicks in the blanked sheet of cardboard containing the plurality of cartons thereon.

FIG. 14 also shows the side support rails 1408 which are fitted onto slots both on the jogging member 301 and on the grid support brackets 901.

Figure 17:
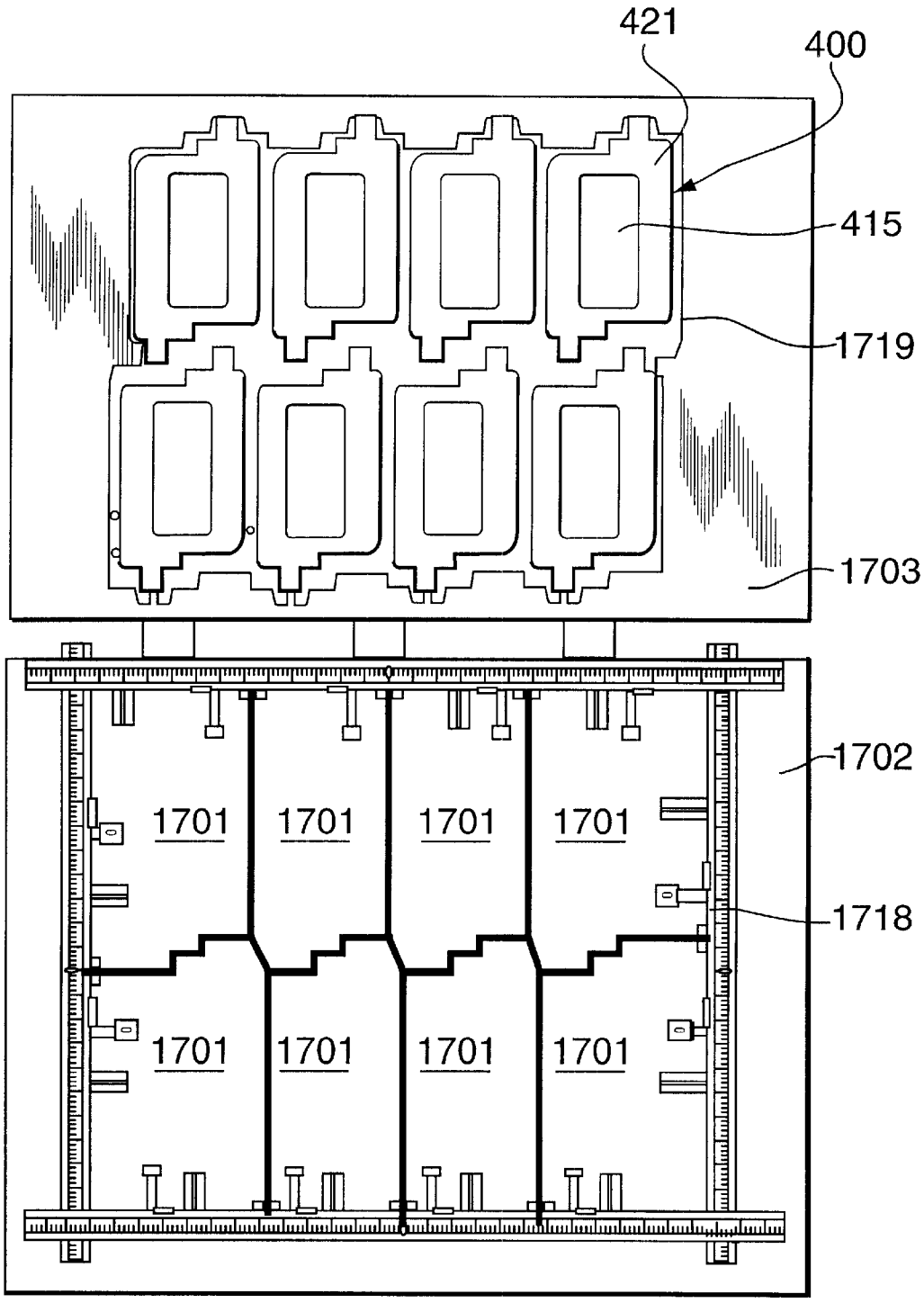
FIG. 17 is a view of a stripping station of the blanking machine of another embodiment of this invention, showing the universal press frame/grid constituting a lower blanking female die of one embodiment of this invention, and the template constituting the upper male blanking die of another embodiment of this invention.
Figure 18:
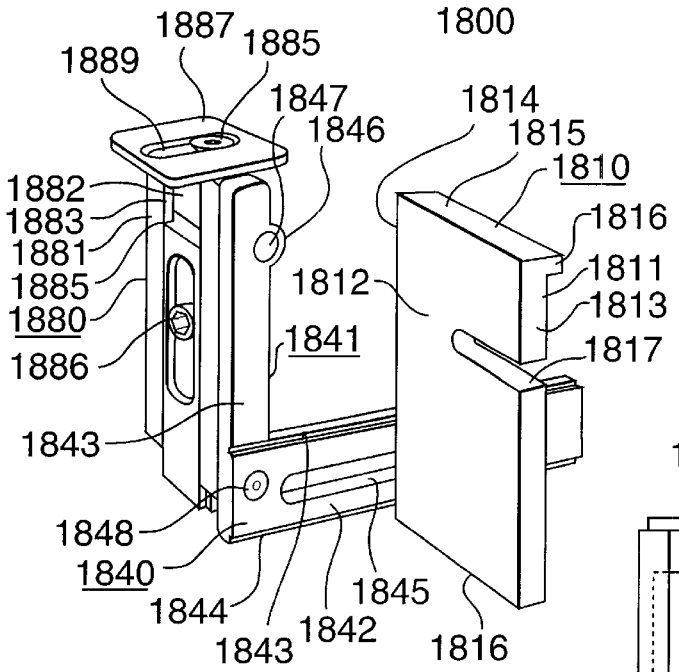
Figure 19:
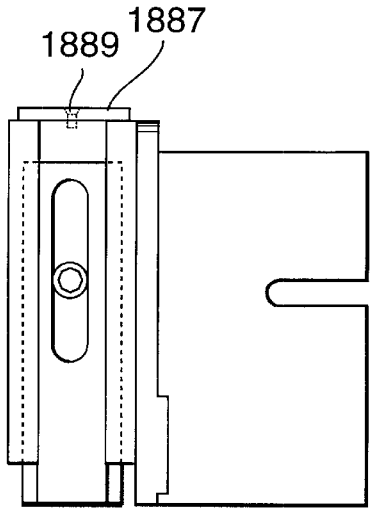
Figure 20:
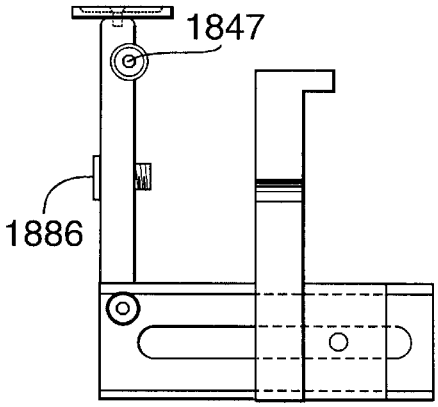
Figure 21:
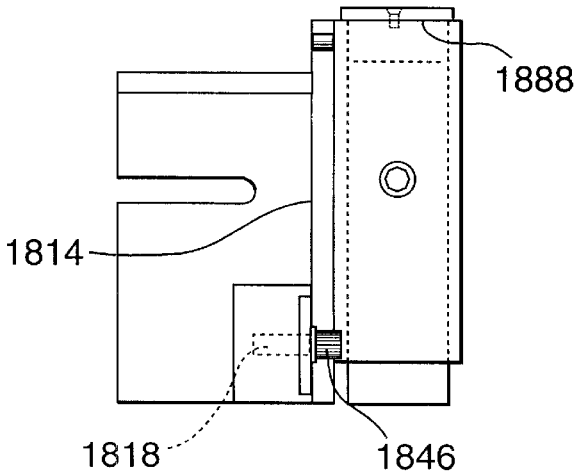

(xii) Description of FIG. 17

FIG. 17 shows the modified blanking station described as 18, 19 in FIG. 11, and constitutes another embodiment of another aspect of this invention.

In this figure, the female blanking die 1718 is that shown in FIG. 13 and so will not be described in further detail. It is mounted on the lower plates 1702 so that the blanked cartons may be pushed through the apertures 1701 in the grid positions 1101 of the female blanking die 1718.

The male blanking die 1719 is provided from the template 400. The template 400, which has had the cylindrical devices 414 removed from the upper surface thereof, is now is placed against the upper (movable) plates 1703 of the press by means of being accurately positioned with screws fitted into the apertures 415 from which the cylindrical members 414 have been removed. The foam plastic blocks 421 are each shaped to coincide with the shape of the blanked cartons. During the movement of the male blanking die, the blocks 421 push the blanked cartons through the apertures 1701.

GENERALIZED DESCRIPTION OF PREFERRED EMBODIMENTS

The above detailed description will now be summarized in the following narrative.

The universal press frame includes a front rail, a rear rail and a pair of outer side rails. Each of these four rails is provided with datum indicia. The datum indicia on the front and rear rails are centre line datum points, with datum extending laterally outwardly to the ends of the front and rear rails, the centre line datum point being "zero". The datum points are preferably designed in mm., for all four rails.

The rails include an upper groove for the mount of the template brackets, the jogger members, the auxiliary support members, and the grid support members to the rails.

Each of the jogger members is arranged along the inner periphery of the universal press frame, with the projection on the outer face fitted within the upper groove on the inner face of the rails, to permit the jogger member to slide freely therealong. A set screw is fitted within the jogger member so as to engage a groove on the inner face of the rails to lock the jogger member in its final position on the rail. The jogger member also includes means whereby the front face can be adjusted inwardly or outwardly.

A plurality of template support brackets are secured at predetermined locations along the inner periphery of the universal press frame, namely, two template mounting blocks secured to each side rail. These support brackets are provided with projections on an outer face thereof which are fitted within the grooves in the inner face of the rails, to permit the template support brackets to slide freely therein. The template mounting blocks are also provided with set screws which engage the grooves in the inner face of the rails to lock the template mounting blocks at their final positions on the rails.

The template is disposed atop the template mounting blocks and is centred on the centre line. This is accomplished by placing the orientation devices in the centring holes which are provided in the template. A centring rule is then disposed in the slots of the orientation devices and the template is then moved transversely until the centring bar points to the "zero" center datum points of the front rail and the back rail. The centring bar is then removed. The template is then moved longitudinally until the side datum are reached. Lasered lines coincide with the datum points on the side rails.

When the longitudinal and lateral position of the template is accurately positioned, the template is rigidly secured to the template mounting blocks by means of set screws. Since the template mounting blocks are provided with a plurality of tapped holes, and since the template is provided with associated slots, the set screws can be accurately placed to hold the template securely to the universal press frame. This simultaneously also provides a rigid stable combination of the universal press frame and the template.

The placement of a grid in the shape of the outline of the butted edges of the plurality of cartons to be blanked is placed atop the template. Accurate positioning is provided by placing the orientating devices in accurately placed holes in the template, these holes being along the lasered outline of the cartons to be blanked. Such lasered outline is provided by the CAD program. The barrels of the orientation devices are then rotated until the slots at the tops of the barrels coincide with the longitudinal and transverse layered outline. The grid, which is made of steel bars, of about ⅛" thick, is placed in the slots whose width is about 5/32" in the orientation devices, and into slots in grid support brackets which are secured to the universal press frame. The ends of the grid are locked to respective grid support brackets by a lock screw. The grid support brackets can then be slid along the universal press frame to the proper position. The grid support brackets are then secured in their accurate positions on the universal press frame, dependent on the accurate location of the grid. In this way the grid is placed in the perfect position as defined by the CAD program for accurate positioning of the female blanking die.

Some of the jogger members may have been previously placed around the inner perimeter of the universal press frame before the template is secured therein. If not all the jogger members have been so-placed, they are so-placed at this time. In any event, when jogger members are selectively disposed along the interior perimeter of the rectangular framework, they are positioned to abut selected perimetrical edges of the layered template. In this way, the jogger members are accurately position.

If the back trim of the carton is removed by the stripper, the jogger members are jogged to abut the back of the layered template. If the side trim of the carton is removed, a side rail is inserted into respective slots in the side jogger members and is secured therein with lock down bolts. This provides support for the side edges of the blanked cartons.

The front trim support is provided with longitudinally extending slots so that it will be longitudinally adjustable to set a distance which provides the shear for breaking the nicks in the blanked cartons.

By these means, the entire female stripping die in the form of the grid is built up. The template assures that the die cutting sheet of cardboard is exactly matched and that the female stripping die is square. The female blanking die is therefore fixed in the die press in register with the datum fixed points. The template includes the grid orientation devices. The jogger members are "fine-tuned" to position them to contact the template perimeter. The front trim support can be longitudinally moved to provide the proper setup for the shear distance.

The template is removed and is allowed to drop down below the universal press frame. This is done by removing the lock screws holding the template to the template mounting blocks and then removing the template mounting blocks from the universal press frame. The template is then removed from underneath the universal press frame. What remain is the entire female blanking die and the universal press frame, ready for mounting in the blanking station of the die press. In addition, the template is now available to become the male blanking die.

The blanking station includes a female blanking die in the form of the grid support frame which is accurately positioned within the universal press frame. The female blanking die was accurately positioned within the universal press frame by means as was described hereinabove.

The template becomes the male blanking die by the following steps. The orientation devices are removed from the upper surface of the template. The template is then secured in the usual fashion to the press by means well known in the art. Such securement is however very accurate and is in registry with the lower female blanking die through the use of the holes from which the orientation devices have been removed. The foam plastic blocks contact the blanked cartons in a manner which does not damage the cartons when the blanked cartons are stripped from the die-cut sheets of cardboard.

(i) Description of FIGS. 18 to 22

FIGS. 18 to 22 depict various embodiments of the jogging member 301. As shown in FIGS. 18 to 21, the jogging member 301 is designated 1800, and includes main upright base member 1810, adjustable support member 1840 and guiding member 1880. Main upright base member 1810 is a generally rectangular block, having rectangular faces 1811, 1812, front and rear edges 1813, 1814 and upper and lower edges 1815, 1816. Upper edge 1815 includes a cantilevered flange 1816, which is adapted to cooperate with the rails of the universal press frame 200 to enable mounting to such rails. In addition, side edge 1811 is provided with an inwardly directed slot 1817 by means of which the jogging member 1800 may be adjustably attached to the rails of the universal press frame 300, by means of screws or bolts (not shown). Finally, front edge 1814 is provided with a tapped aperture 1818 by means of which the adjustable support member 1840 may be attached.

Adjustable support member 1840 comprises an "L"-shaped member 1841 including a horizontal leg 1842 and a vertical arm 1843. Horizontal leg 1842 includes upper 1843 and lower 1844 longitudinal cut-outs which cooperate with associated complementary slots in the front edge 1814 of the main upright base member 1810. It also includes a longitudinally-extending slot 1845 by means of which leg 1842 may be adjustably held to main upright member by means of bolt 1840 within tapped aperture 1818.

The vertical arm 1843 includes an upper semi-circular protrusion 184 through which a bolt 1847 extends to secure the arm 1843 (and hence the "L"-shaped member 1841) to the guiding member 1880. In addition, the leg 1842 is also provided with an aperture through which bolt 1848 secures the "L"-shaped member 1841 to the guiding member 1880.

Guiding member 1880 includes a main vertical bar 1881 including central groove 1882 which is provided with lateral underscored groove 1883. A guiding head 1884 which includes flanges 1885 which are complementary with underscored grooves 1883 is slidably held to bar 1881 by means of bolt 1886 which is screwed into an aperture on central groove 1882.

A cap 1887 is selectively adjustably held to the top face 1888 of bar 1881 by means of screw 1889 into a tapped aperture in top face 1888, the screw being within slot 1889 in cap 1887.

Figure 22:
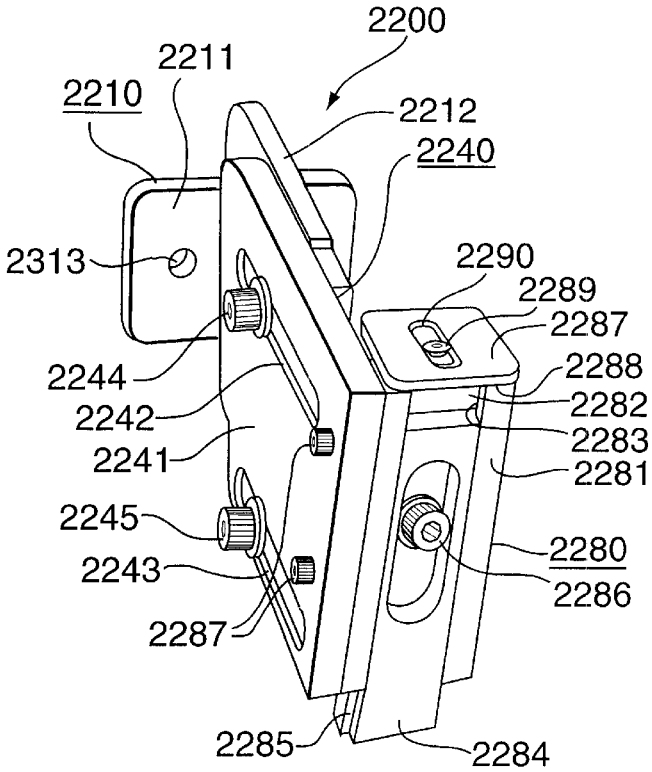
FIG. 22 is a perspective view of another embodiment of the jogging member of one embodiment of this invention.

FIG. 22 shows another variant of the jogger member 301, designated here as 2200. This jogger member 2200 includes a main upright base member 2210, adjustable support member 2240 and guiding member 2280. Main upright base member 2210 is in the form of a "T" element, including a transverse plate 2211, which is integrally connected to a longitudinally-extending plate 2212. Transverse plate 2210 is of a dimension enabling it to cooperate with the rails of the universal press frame 200. Plate 2210 also includes two through tapped holes, only one of which, 2213 being seen, into which a lock bolt or screw (not seen) can be threaded to engage the rail of the universal press frame to secure the jogger member 2200 in position in the universal press frame 200.

The longitudinally-extending plate 2211 is provided with two, vertically-spaced-apart, tapped apertures (not seen) whose purpose will be explained later.

The adjustable support member 2240 comprises a generally-rectangular plate 2241. Plate 2241 includes a pair of longitudinally extending, vertically-spaced-apart parallel slots 2242, 2243. Lock bolts 2244, 2245 pass through slots 2242, 2243, respectively and enter the above mentioned tapped apertures in the longitudinally-extending plate 2211. When the adjustable support member 2240 is disposed in its desired position with respect to the universal press frame 200 and the template 400, the bolts 2244, 2245 are tightened to lock the plate 2241 in position.

Guiding member 2280 includes a main vertical bar 2281 including a central groove 2282 which is provided with lateral underscored groove 2283. A guiding head 2284 which include flanges 2285 which are complementary with underscored grooves 2283, is slidably held to bar 2281 by means of bolt 2286 which is screwed into an aperture (not seen) in central groove 2282. Guiding member 2280 is secured to adjustable support member 2240 by means of two vertically-spaced apart bolts 2287 which are threaded into tapped apertures (not seen) in one face of the guiding member 2280.

A cap 2287 is selectively adjustably held to the top face 2288 of bar 2281 by means of screw 2289 into a tapped aperture (not seen) in top face 1888, the screw being within slot 2290 in cap 2287.

Figure 23:
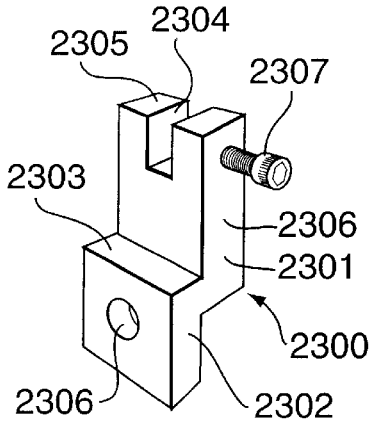
FIG. 23 is a perspective view of a typical grid support bracket.

(ii) Description of FIG. 23

FIG. 23 shows in detail one embodiment of the grid support bracket 901, designated as 2300. This grid support bracket 2300 is generally step-shaped and includes an upper vertical arm 2301 and a lower vertical leg 2302, which are joined by a horizontal deck 2303. Upper vertical arm 2301 includes a vertical slot 2304, extending downwardly from its upper edge 2305. A tapped through aperture is formed in one side face 2306 of the upper vertical arm 2301, into which is inserted a lock bolt 2307. When used in conjunction with the grid 1101, the bolt 2307 is turned until it contacts and locks the grid 1101 into the slot 2304.

The lower leg 2302 is of a dimension to enable it to cooperate with the rails of the universal press frame 200. Lower leg 2302 also includes a through tapped hole 2306 into which a lock bolt or screw (not seen) can be threaded to engage the rail of the universal press frame to secure the grid support bracket 2300 in position on the universal press frame 200.

Figure 25:
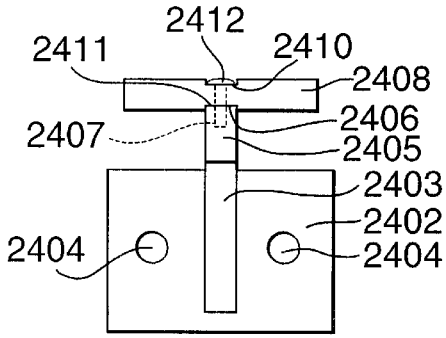
FIG. 25 is front elevational view of the auxiliary support bracket of FIG. 24.
Figure 24:
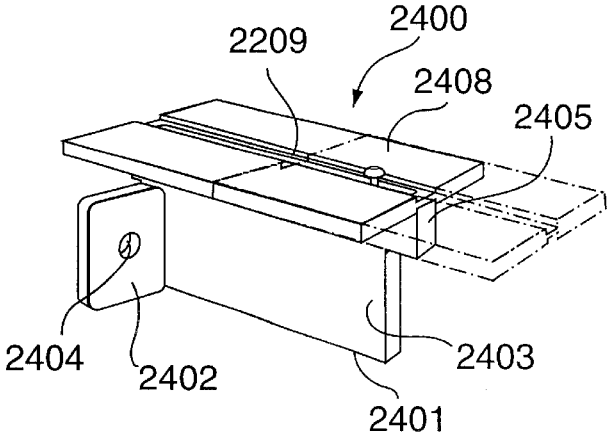
FIG. 24 is a perspective view of a typical auxiliary support bracket.

(iii) Description of FIG. 24 and FIG. 25

FIGS. 24 and 25 show one embodiment of an auxiliary adjustable support table 801, designated as 2400. This auxiliary support table 2400 includes a support base 2401 comprising a transverse plate 2402 and an integral longitudinal plate 2403. Transverse plate 2402 is of a dimension enabling it to cooperate with the rails of the universal press frame 200. Plate 2402 also includes two through tapped holes 2204 into which a lock bolt on screw (not seen) can be threaded to engage the rail of the universal press frame to secure the jogger member 2200 in position in the universal press frame 200.

Longitudinal plate 2403 includes an integral upper cantilevered plate 2405, the upper face 2406 thereof being provided with a tapped aperture 2407.

The auxiliary support table 2400 includes a captive, longitudinally-slidable table 2408 having a longitudinally extending slot 2409 therein, and upper and lower grooves 2410, 2411 which are complementary to the slot 2409. Table 2408 is held captive on plate 2405 by means a screw 2412. The table 2408 can thus be adjusted longitudinally as shown in dot-and-peck lines.

Figure 26:
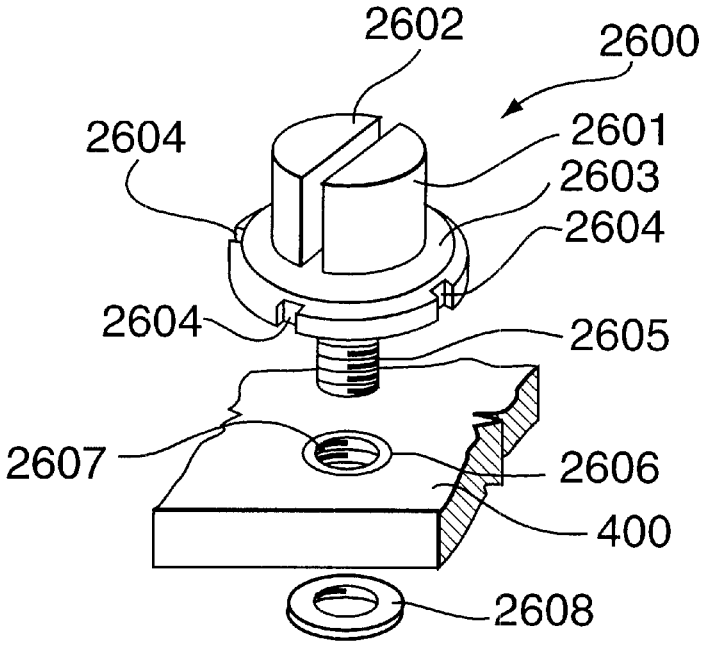
FIG. 26 is a perspective view of a typical orientation device prior to its securement to the template.
Figure 27:
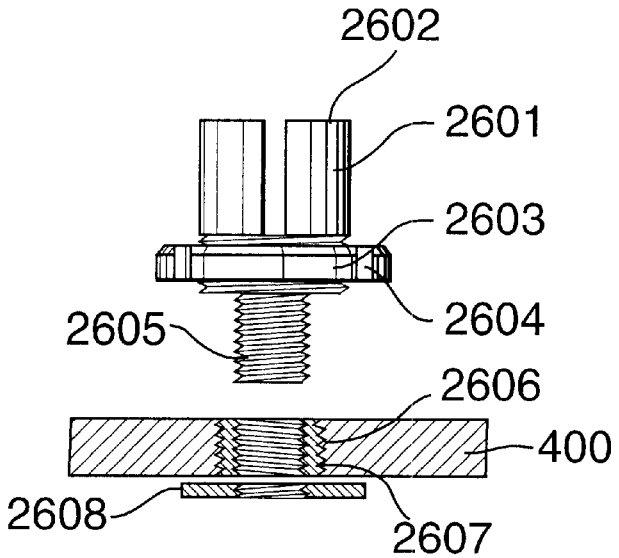
FIG. 27 is a side view of an orientation device prior to its securement to the template.

FIGS. 26 and 27 show one embodiment of the orientation device 404, designated herein as 2600. Orientation device 2600 includes an upper cylinder, which is provided with a diametrical through groove 2602. Cylinder 2601 rests upon, and is integral with disc-like collar 2603 which includes a plurality of circumferentially arranged engagement nicks 2604. Finally, orientation device 2600 includes a depending integral threaded base 2605.

The template 400 is provided with a through hole 206 for each orientation device 2600. A "T"-nut 2607 is secured within hole 2606.

When the threaded base 2605 is threaded completely through the "T"-nut 2607 in the template 400, and the slot 2602 is correctly oriented, the orientation device is secured at that correctly oriented position by means of interiorly threaded lock washer 2608.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What is claimed is:

1. A universal press frame for use in conjunction with a female blanking die for a die cutting machine for carrying out at least one of die cutting a carton blank and blanking a carton blank, said universal press frame comprising:

a rectangular framework having two opposed side rails, a front rail and a rear rail;

a plurality of grid support members, each grid support member having a slot across its upper face, said grid support members being selectively disposed along said two opposed side rails, along said front rail and along said rear rail of said rectangular framework on said interior perimeter of said rectangular framework;

a grid which is supported within said slots of said grid support members, and comprising a plurality of intersecting rails, the pattern of said intersecting rails coinciding with the shape of abutting portions of a plurality of cartons which are contained on a sheet of cardboard which has been die-cut by a male cutting die of said die cutting machine;

a plurality of jogger members which are selectively disposed along said interior perimeter of said rectangular framework, each said jogger member comprising a base member, an adjustable support member which is adjustably-slidably disposed along a longitudinal axis of said base member, and a guiding member having an upper edge and a lower edge, said guiding member being secured to one face of said adjustable support member to provide a depending guiding face to which said jogger member is secured;

whereby said plurality of jogger members are oriented along said interior perimeter of said rectangular framework in such a way that an imaginary perimeter which would be defined by joining said guiding faces of said guiding members constitutes a perimeter that is substantially-identical to the outer perimetrical shape of a sheet of cardboard containing a plurality of said carton blanks which have been die-cut by a male cutting die of said die cutting machine.

2. The universal press frame as claimed in claim 1, wherein each of said plurality of jogger members also includes slidable captive cap means having a leading edge, said slidable captive cap means being slidably secured to said guiding member for selective disposition of its leading edge a predetermined cantilevered distance over said guiding face of said guiding member;

whereby said plurality of jogger members are oriented along said interior perimeter of said rectangular framework in such a way that said leading edges of said slidable captive cap means which are atop said guiding members extend as far as an imaginary perimeter which would be defined by joining said leading edges of said slidable captive cap means which constitutes a perimeter that is substantially-similar to, but is slightly larger than, said perimetrical shape of a sheet of cardboard containing carton blanks which have been die-cut by said male cutting die of said die cutting machine, whereby said slidable captive cap means provide a temporary support for selected areas of said sheet of cardboard containing carton blanks which have been die-cut by said male cutting die of said die cutting machine.

3. The universal press frame as claimed in claim 2, wherein said base member of each said jogger member is provided with an additional element which is secured to said base but which is slidable in a direction which is perpendicular to said guiding face of said guiding member of said jogger member, said additional element including a pair of side L-shaped supports, a leg of each L-shaped side support being fitted into slots in an upper edge of said jogger members at each associated side of said universal press frame, an arm of each L-shaped side support extending inwardly into said lateral area of said universal press frame, thereby to provide support for associated side edges of said sheet of cardboard containing said plurality of cartons which have been die-cut by said male cutting die.

4. The universal press frame as claimed in claim 1, which further comprises:

a plurality of auxiliary adjustable support members each of which is adjustably-slidably disposed along a longitudinal axis of said base member, each said auxiliary adjustable supporting member comprising a base member for securement to said rectangular framework, and an adjustable captive supporting table having a leading edge, said adjustable captive supporting table being slidably-adjustably disposed with respect to said base member to have said leading edge oriented substantially-parallel to a part of said universal press frame to which said supporting member is secured;

whereby said plurality of jogger members are oriented along said interior perimeter of said rectangular framework in such a way that said plurality of auxiliary adjustable support members are oriented along said interior perimeter of said rectangular framework in such a way that an imaginary perimeter which would be defined by joining said front edges of said adjustable captive supporting tables constitutes a perimeter that is substantially similar to, but is slightly larger than, said perimetrical shape of a sheet of cardboard containing carton blanks which have been die-cut by said male cutting die of said die cutting machine.

5. The universal press frame as claimed in claim 4, wherein said base member of each said jogger member is provided with an additional element which is secured to said base but which is slidable in a direction which is perpendicular to said guiding face of said guiding member of said jogger member, said additional element including a pair of side L-shaped supports, a leg of each L-shaped side support being fitted into slots in an upper edge of said jogger members at each associated side of said universal press frame, an arm of each L-shaped side support extending inwardly into said lateral area of said universal press frame, thereby to provide support for associated side edges of said sheet of cardboard containing said plurality of cartons which have been die-cut by said male cutting die.

6. The universal press frame as claimed in claim 1, wherein each of said plurality of jogger members also includes:

slidable captive cap means having a leading edge, said slidable captive cap means being slidably secured to said guiding member for selective disposition of its leading edge a predetermined cantilevered distance over said guiding face of said guiding member; and a plurality of auxiliary adjustable support members, each of which is adjustably-slidably-disposed along a longitudinal axis of said base member, each said adjustable support member comprising a securement member for securement to said rectangular framework, and an adjustable captive supporting table having a leading edge, said adjustable captive supporting table being slidably-adjustably disposed with respect to said securement member to have said leading edge oriented substantially-parallel to a part of said universal press frame to which said support member is secured;

whereby said plurality of jogger members are oriented along said interior perimeter of said rectangular framework in such a way that said leading edges of said slidable captive cap members which are atop said guiding members extend as far as an imaginary perimeter which would be defined by joining said leading edges of said slidable captive cap members which constitutes a perimeter that is substantially similar to, but is slightly larger than, said perimetrical shape of a sheet of cardboard containing said carton blanks which have been die-cut by said male cutting die of said die cutting machine, and whereby said plurality of auxiliary supporting members are oriented along said interior perimeter of said rectangular framework in such a way that an imaginary perimeter which would be defined by joining said front edges of said adjustable captive supporting tables constitutes a perimeter that is substantially similar to, but is slightly larger than, said perimetrical shape of a sheet of cardboard containing said carton blanks which have been die-cut by said male cutting die of said die cutting machine, whereby said slidable captive cap means provide a temporary support for selected areas of said sheet of cardboard containing said carton blanks which have been die-cut by said male cutting die of said die cutting machine, and whereby said adjustable support tables provide a temporary support for other selected areas of said sheet of cardboard containing said carton blanks which have been die-cut by said male cutting die of said die cutting machine.

7. The universal press frame as claimed in claim 6, wherein said base member of each said jogger member is provided with an additional element which is secured to said base but which is slidable in a direction which is perpendicular to said guiding face of said guiding member of said jogger member, said additional element includes a pair of side L-shaped supports, a leg of each L-shaped side support being fitted into slots in an upper edge of said jogger members at each associated side of said universal press frame, an arm of each L-shaped side support extending inwardly into said lateral area of said universal press frame, thereby to provide support for associated side edges of said sheet of cardboard containing said plurality of cartons which have been die-cut by said male cutting die.

8. The universal press frame as claimed in claim 1, wherein each of said plurality of jogger members also includes: slidable captive cap means having a leading edge, said slidable captive cap means being slidably secured to said guiding member for selective disposition of its leading edge a predetermined cantilevered distance over said guiding face of said guiding member; a plurality of auxiliary adjustable support members, each of which is adjustably-slidably-disposed along a longitudinal axis of said base member, each said adjustable support member comprising a base member for securement to said rectangular framework; and an adjustable captive supporting table having a leading edge, said adjustable captive supporting table being slidably-adjustably disposed with respect to said base member to have said leading edge oriented substantially-parallel to a part of said universal press frame to which said supporting member is secured;

whereby said plurality of jogger members are oriented along said interior perimeter of said rectangular framework in such a way that said leading edges of said slidable captive cap members which are atop said guiding members extend as far as an imaginary perimeter which would be defined by joining said leading edges of said slidable captive cap members which constitutes a perimeter that is substantially similar to, but is slightly larger than, said perimetrical shape of a sheet of cardboard containing said carton blanks which have been die-cut by a male cutting die of said die cutting machine whereby said slidable captive cap means provide a temporary support for selected areas of said sheet of cardboard containing said carton blanks which have been die-cut by said male cutting die of said die cutting machine; and whereby said plurality of auxiliary supporting members are oriented along said interior perimeter of said rectangular framework in such a way that an imaginary perimeter which would be defined by joining said front edges of said adjustable captive supporting tables constitutes a perimeter that is substantially similar to, but is slightly larger than, said perimetrical shape of a sheet of cardboard containing said carton blanks which have been die-cut by said male cutting die of said die cutting machine, whereby said adjustable captive supporting tables provide a temporary support for other selected areas of said sheet of cardboard containing said carton blanks which have been die-cut by said male cutting die of said die cutting machine.

* * * * *